US011795944B1

(12) United States Patent
Oliverio et al.

(10) Patent No.: US 11,795,944 B1
(45) Date of Patent: Oct. 24, 2023

(54) HYDRAULIC PUMP TO SYNCHRONIZE THE OPERATION OF A PAIR OF HYDRAULIC ACTUATORS

(71) Applicants: John D. Oliverio, Brandon, FL (US); Amit Patel, Wesley Chapel, FL (US); Edward J. Shynski, Tampa, FL (US); Christopher Smith, Clearwater, FL (US)

(72) Inventors: John D. Oliverio, Brandon, FL (US); Amit Patel, Wesley Chapel, FL (US); Edward J. Shynski, Tampa, FL (US); Christopher Smith, Clearwater, FL (US)

(73) Assignee: JL MARINE SYSTEMS INC.

( * ) Notice: Subject to any disclaimer, the term of this patent is extended or adjusted under 35 U.S.C. 154(b) by 241 days.

(21) Appl. No.: 17/300,544

(22) Filed: Aug. 10, 2021

Related U.S. Application Data

(60) Provisional application No. 63/103,553, filed on Aug. 11, 2020.

(51) Int. Cl.

| | |
|---|---|
| ***F15B 11/22*** | (2006.01) |
| ***F04C 2/08*** | (2006.01) |
| ***F15B 7/00*** | (2006.01) |
| ***F15B 9/08*** | (2006.01) |
| ***F15B 9/10*** | (2006.01) |
| ***F15B 9/16*** | (2006.01) |
| ***F15B 13/02*** | (2006.01) |
| ***F15B 13/08*** | (2006.01) |

(52) U.S. Cl.
CPC ..... *F04C 2/08* (2013.01); *F15B 7/006* (2013.01); *F15B 9/08* (2013.01); *F15B 9/10* (2013.01); *F15B 9/16* (2013.01); *F15B 11/22* (2013.01); *F15B 13/024* (2013.01); *F15B 13/027* (2013.01); *F15B 13/0807* (2013.01); *F15B 7/00* (2013.01); *F15B 13/02* (2013.01)

(58) Field of Classification Search
CPC ..... F15B 11/22; F15B 2211/782
See application file for complete search history.

(56) References Cited

U.S. PATENT DOCUMENTS 3,625,115 A * 12/1971 Tani ..... F15B 11/22 91/515
4,324,411 A * 4/1982 Mackenzie ..... A01B 63/22 280/43.23
4,949,540 A * 8/1990 Wich ..... F15B 11/22 137/99

(Continued)

*Primary Examiner* — Michael Leslie
(74) *Attorney, Agent, or Firm* — Arthur W. Fisher, III

(57) ABSTRACT

A hydraulic pump to synchronize the operation of a pair of hydraulic actuators wherein each hydraulic actuator comprises a cylinder including a first fluid port and a second fluid port formed in the proximal and distal end portions thereof respectively and having a piston disposed therein coupled to a piston rod at least partially disposed within the corresponding cylinder. The dual hydraulic pump includes a triple gear assembly to alternately feed pressurized hydraulic fluid to the first fluid port of each hydraulic actuator simultaneously or the second fluid port of each hydraulic actuator simultaneously to synchronize the linear movement of each piston and piston rod in a first direction or a second direction.

32 Claims, 14 Drawing Sheets

(56) References Cited

U.S. PATENT DOCUMENTS

| | | | | |
|---|---|---|---|---|
| 6,276,465 | B1 * | 8/2001 | Cooley | E21B 10/00 175/45 |
| 7,322,190 | B2 * | 1/2008 | Bair | F15B 11/22 91/515 |
| 10,081,523 | B2 * | 9/2018 | Brown | B66F 7/28 |
| 10,544,810 | B2 * | 1/2020 | Afshari | F04C 2/14 |

* cited by examiner

HYDRAULIC PUMP TO SYNCHRONIZE THE OPERATION OF A PAIR OF HYDRAULIC ACTUATORS

CROSS-REFERENCE

This is a utility application of co-pending provisional application Ser. No. 63/103,553, filed Aug. 11, 2020.

BACKGROUND OF THE INVENTION

Field of the Invention

A hydraulic external gear pump to synchronize the operation of two hydraulic actuators.

Description of the Prior Art

The prior art described below discloses a number of examples of multi-gear hydraulic pumps, and pumps with manifolds and hydraulic systems to synchronize operation of various assemblies such as multiple winches.

Gear pumps use the meshing of gears to pump fluid by displacement. They are one of the most common types of pumps for hydraulic fluid power applications. There are two main variations: external gear pumps which use external spur gears and internal gear pumps which use an external and an internal spur gears. Gear pumps are positive displacement or fixed displacement meaning they pump a constant amount of fluid for each revolution. Some gear pumps are designed to function as either a motor or a pump. As gears rotate, they separate on the intake side of the pump, creating a void and suction which is filled by fluid. The fluid is carried by the gears to the discharge side of the pump, where the meshing of the gears displaces the fluid. The mechanical clearances are generally small in the order of 10 um. The tight clearances, along with the speed of rotation, effectively prevent the fluid from leaking backwards. The design of the gears and housing allow for very high pressures and the ability to pump highly viscous fluids.

U.S. Pat. No. 8,672,657 discloses a multiple gear pump comprising a drive gear and two idler gears that are oppositely arranged with the drive gear disposed therebetween.

U.S. Pat. Nos. 3,873,241, 3,873,252 and 3,951,575 describe a gear pump and motor having a plurality of pumps and motors each of which have at least three gears operatively engaging each other, seal members disposed adjacent to the gears and control means for selectively controlling the movement of the seal members toward or away from the gears of the pumps and motors to selectively actuate the pumps and motors.

U.S. Pat. No. 6,540,493 shows a series gear pump for differing output volumes with at least two gear pumps. Each gear pump comprises at least two intermeshing displacing elements: a first displacing gear and a second displacing gear.

U.S. Pat. No. 3,299,825 relates to a pump or motor comprising a housing, first and second shafts arranged side by side disposed within the housing and mounted to rotate in opposite directions, a first sheave means keyed to the first shaft and carrying a set of segment members protruding in axial direction from one side of the first sheave means and a second sheave means keyed to a second shaft and carrying a set of protruding segment members protruding in axial direction from one side of second sheave means. The second sheave means is axially spaced from the first sheave means with each set of segment members being received within a respective one of two ring channels arranged within the housing so as to overlap at a portion thereof. The sets of segment members are meshing so that a segment member of the first sheave means will engage into the space between two successive segment members of the second sheave means.

U.S. Pat. No. 3,828,683 shows a system to transfer a load comprising a three-drum winch that controls three lines, a set of sheaves mounted on a kingpost or mast on a supply ship, a block mounted to a padeye on a receiving ship and a trolley that rides the lines between ships and raises, lowers and transports the load.

U.S. Pat. No. 4,088,304 discloses a winch system control mechanism for the simultaneous control of two winch motors comprising a servo valve connected to an adjustable cylinder double drive pump to regulate the fluid pressure delivered from the pump to a winch motor driving a respective winch drum over which the respective cable or rope is engaged. The arrangement includes a control mechanism connected between the control means for the servo valve of each of the winch motors which operates to permit a varying of the driving pressure fluid which acts on the drum in accordance with the heaving pressure produced on the associated winch drum by the action of the cable or line so that the fluid pressure acting on a first winch motor is controlled as a function of the tension of the rope on the other winch drum causing a reverse rotation of the drum and a build up of the pressure in the system which effects a change in the heaving operation of the first drum.

U.S. Pat. No. 4,223,871 relates to a winch mechanism for lifting objects from the surface of the sea comprises two or more variable pressure constant displacement hydraulic pumps/motors coupled to drive a rope haulage mechanism; a pump connected for pumping operating fluid to the hydraulic pumps/motors; a fluid accumulator branched from the high pressure fluid supply line from the pump to the pump/motors; and first and second non-return valves. The first non-return valve is disposed in the high pressure fluid supply line between the fluid accumulator and the pumps/motors to limit the flow of fluid from the accumulator to only one of the pumps/motors, and the second non-return valve is disposed between the high pressure fluid line and a low pressure fluid return line to permit the other pumps/motor(s) to act as a pump.

U.S. Pat. No. 7,155,910 describes a check valve mechanism for a direct drive, reversible hydraulic power source for hydraulic circuits that includes a manifold hydraulically coupled to the respective input/output ports and a reservoir of the hydraulic power source defining a translation passageway having mid-passage drain hydraulically coupled to the reservoir where each end of the translation passageway has an angled annular valve seat opening to larger diameter plenum containing a check valve ball.

U.S. Pat. No. 8,438,671 discloses a system for sequentially supporting, opening and closing a pool-deck lid covering below-deck troughs housing coordinated with the operation of powered pool cover systems housed in the troughs comprising a front, longitudinal seating structure, an upwardly movably, cantilever bracket structure, hydraulic/pneumatic means, and a hydraulic/pneumatic actuation control means.

While some of the prior art may contain some similarities relating to the present invention, none of them teach, suggested or include all of the advantages and unique features of the invention disclosed hereafter.

SUMMARY OF THE INVENTION

The present invention relates to a hydraulic pump to synchronize the operation of a pair of hydraulic actuators wherein each hydraulic actuator comprises a cylinder including a first fluid port and a second fluid port formed in the proximal and distal end portions thereof respectively and each having a piston disposed therein coupled to a corresponding piston rod at least partially disposed within the corresponding cylinder.

The hydraulic pump includes a triple gear assembly to alternately feed pressurized hydraulic fluid to the first fluid port of each hydraulic actuator simultaneously or the second fluid port of each hydraulic actuator simultaneously to synchronize the linear movement of each piston and corresponding piston rod in a first direction when pressurized hydraulic fluid is fed through the first fluid ports to apply fluid pressure to the proximal sides of the pistons moving the corresponding pistons and piston rods toward the distal end of the corresponding cylinder and each piston and corresponding piston rod move in a second direction when pressurized hydraulic fluid is fed through the second fluid ports to apply fluid pressure to the distal sides of the pistons moving the corresponding pistons and piston rods toward the proximal end of the corresponding cylinder to alternately move the hydraulic actuators in a first direction and a second direction respectively.

This Summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

The present invention relates to a hydraulic external gear pump to synchronize the operation of two independent hydraulic actuators. For example, the hydraulic external gear pump may be used to simultaneously lower and raise a pair of anchor devices similar to the shallow water anchor described in U.S. Pat. No. 6,041,730.

Figure 1:
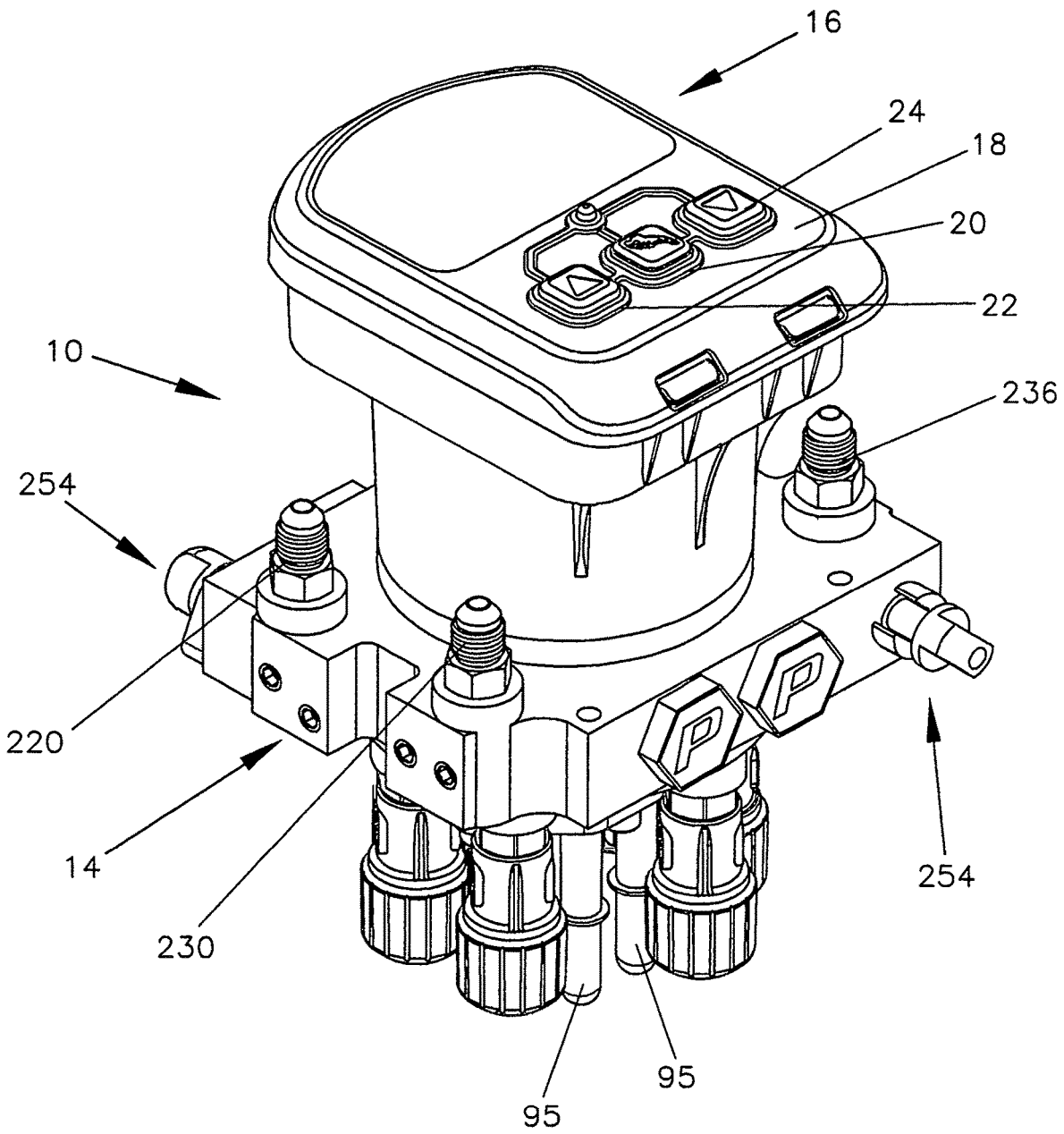
FIG. 1 is a perspective view of the hydraulic external gear pump of the present invention.
Figure 2:
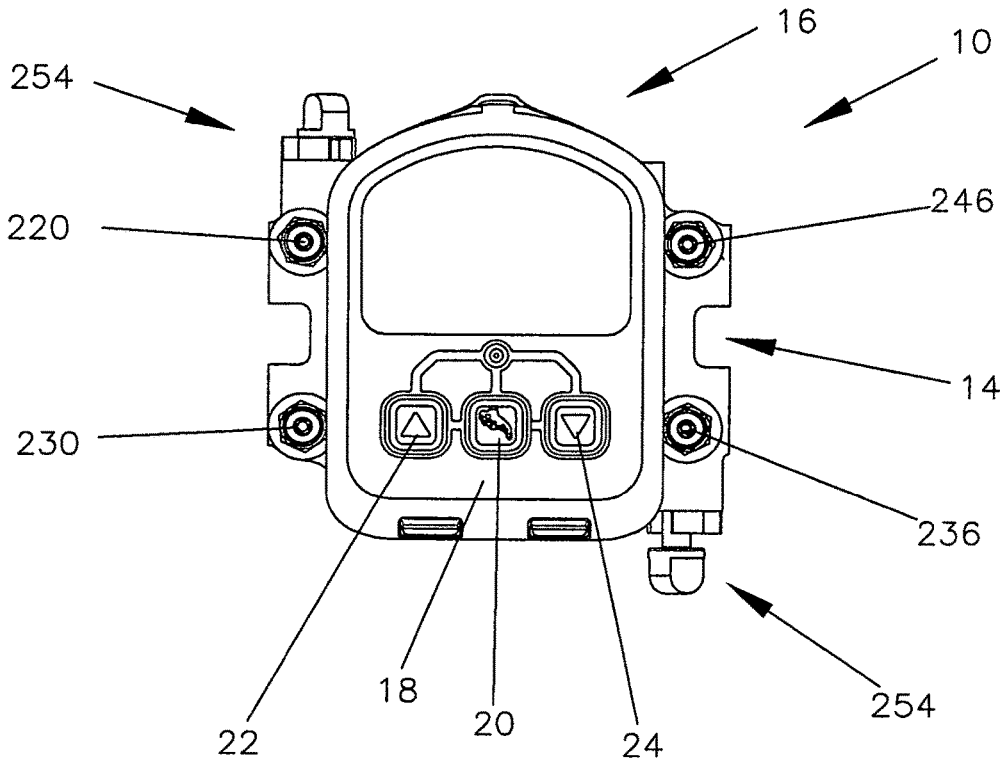
FIG. 2 is a top view of the hydraulic external gear pump of the present invention.
Figure 3:
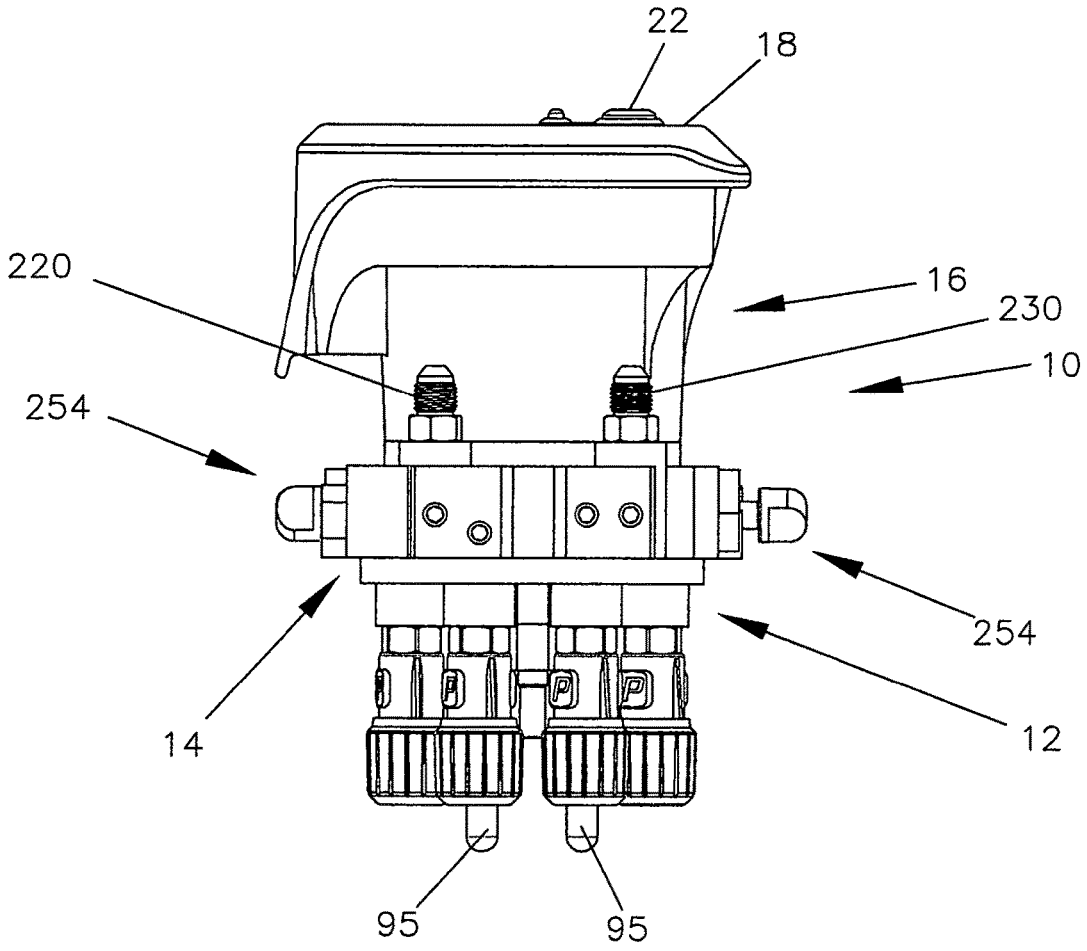
FIG. 3 is a side view of the hydraulic external gear pump of the present invention.

As shown in FIGS. 1 through 3, the hydraulic external gear pump generally indicated as 10 comprises a fluid circulation gear box generally indicated as 12 and a manifold generally indicated as 14 together with a housing generally indicated as 16 to house a reversible electric drive motor (not shown) together with circuitry and logic to control operation of the hydraulic external gear pump 10 and to support a control panel 18 to control the operation of the hydraulic external gear pump 10.

The fluid circulating gear box 12 comprises a first gear box fluid flow branch and a second gear box fluid flow branch for both a first hydraulic actuator (not shown) and a second hydraulic actuator (not shown), and a first manifold fluid flow branch and a second manifold fluid flow branch for both the first hydraulic actuator (not shown) and the second hydraulic actuator (not shown).

As described hereinafter the first gear box fluid flow branch of the first hydraulic actuator (not shown) and the first manifold fluid flow branch of the first hydraulic actuator (not shown) form a first actuator fluid flow path between the reservoir (not shown) and the first hydraulic actuator (not shown). The second gear box fluid flow branch of the first hydraulic actuator (not shown) and the second manifold fluid flow branch of the first hydraulic actuator (not shown) form a second actuator fluid flow path between the reservoir (not shown) and the first hydraulic actuator (not shown).

The first gear box fluid flow branch of the second hydraulic actuator (not shown) and the first manifold fluid flow branch of the second hydraulic actuator (not shown) form a first actuator fluid flow path between the reservoir (not shown) and the second hydraulic actuator (not shown). The second gear box fluid flow branch of the second hydraulic actuator (not shown) and the second manifold fluid flow branch of the second hydraulic actuator (not shown) form a second actuator fluid flow path between the reservoir (not shown) and the second hydraulic actuator (not shown).

As best shown in FIGS. 1 and 2, the control panel 18 includes a manual programming or pairing to a wireless device button or switch 20, a first actuator button or switch 22 and a second actuator or switch 24. Of course, other controls may be added or substituted for these specific control buttons or switches.

Figure 4:
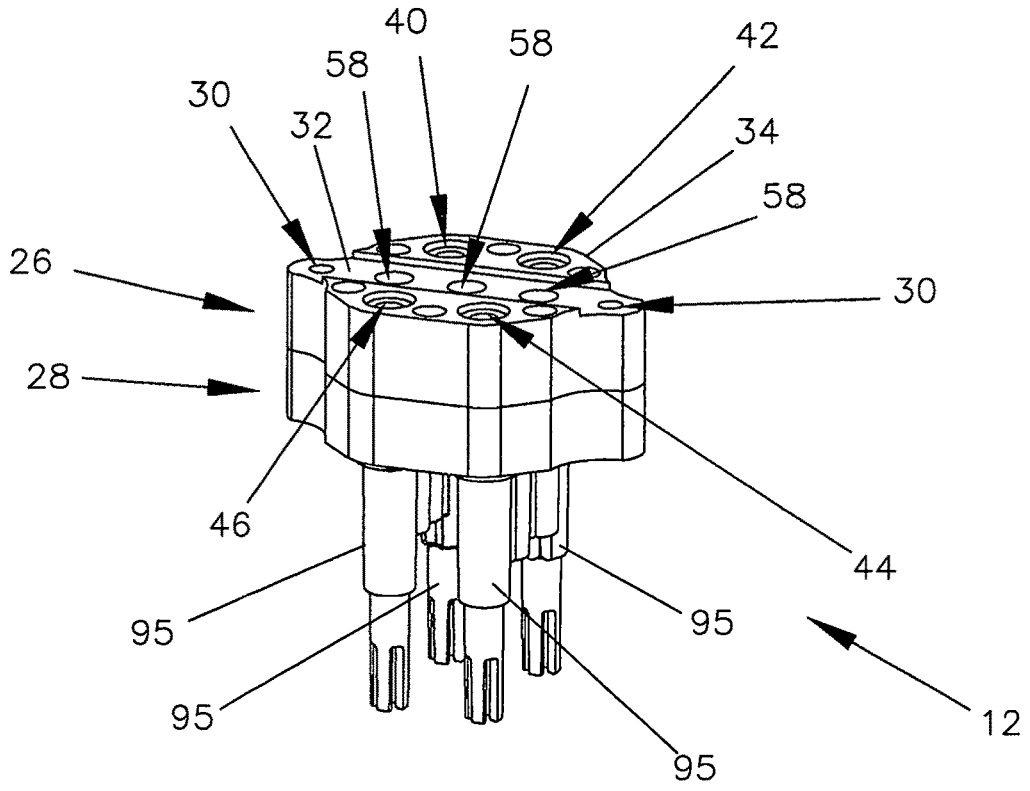
FIG. 4 is a perspective view of the fluid circulation gear box of the present invention.
Figure 5:
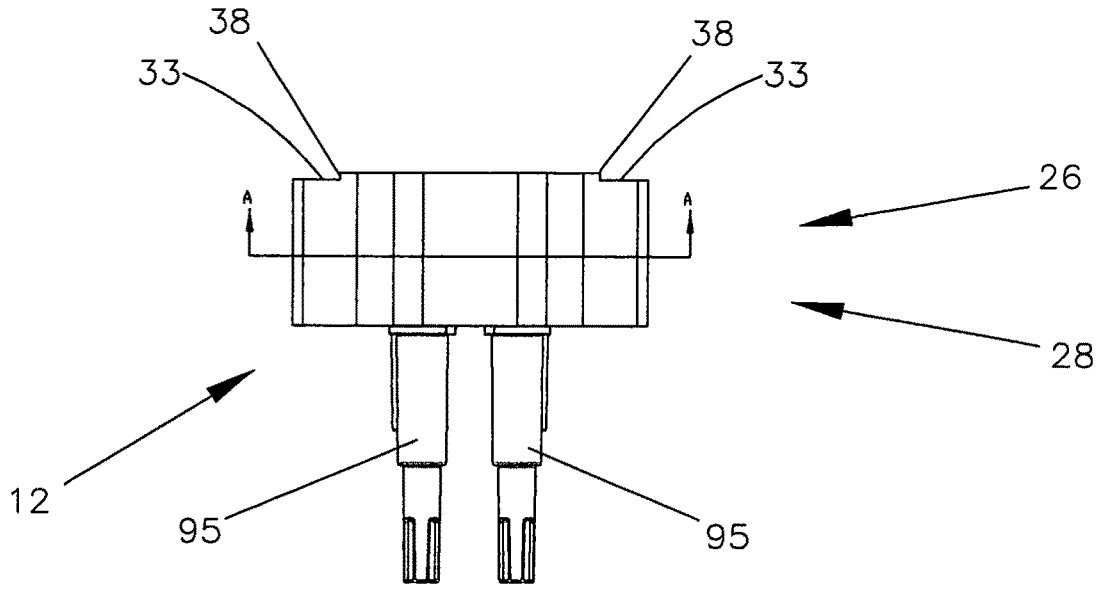
FIG. 5 is a side view of the fluid circulation gear box of the present invention.
Figure 14:
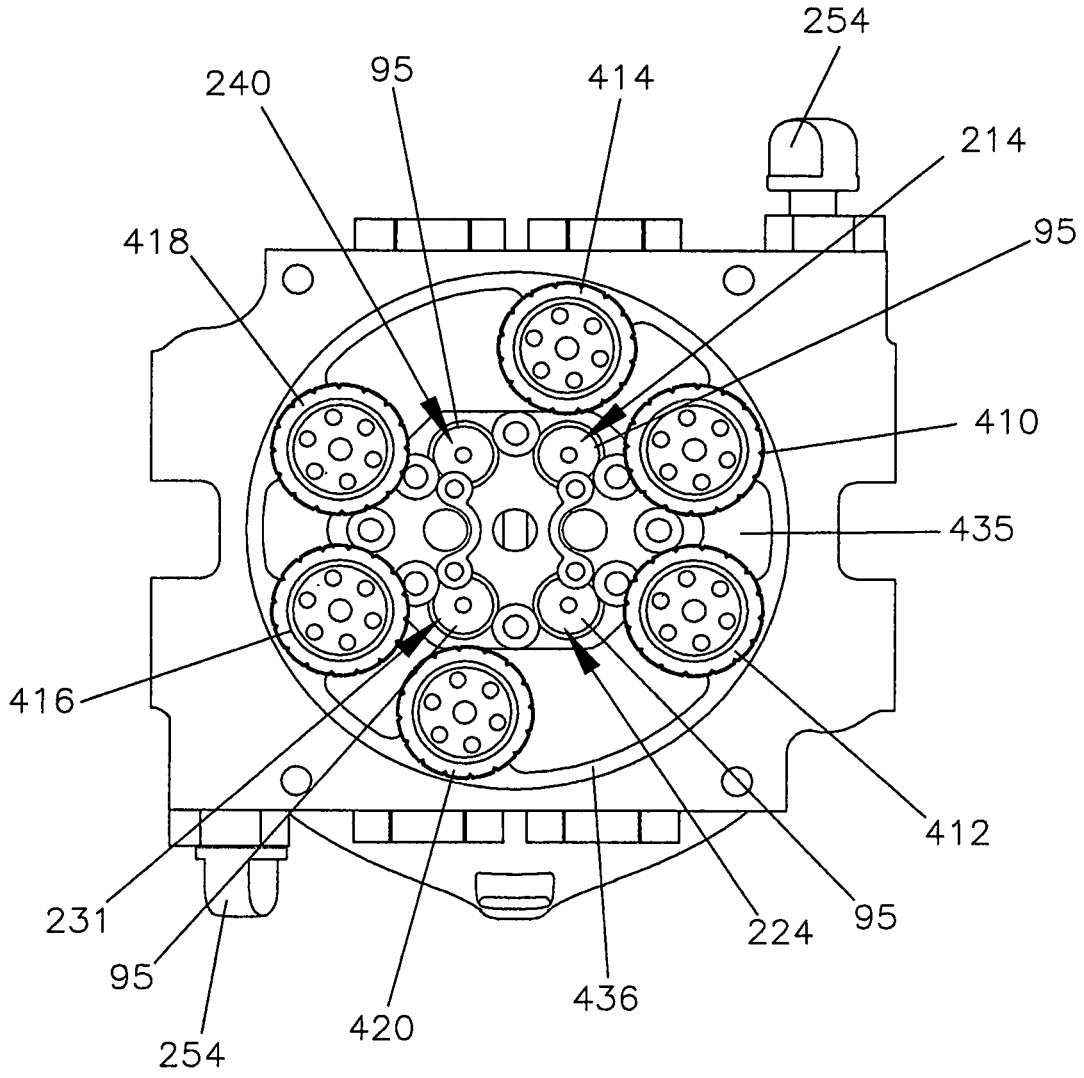
FIG. 14 is a bottom view of the pressure relief valves of the present invention.
Figure 15:
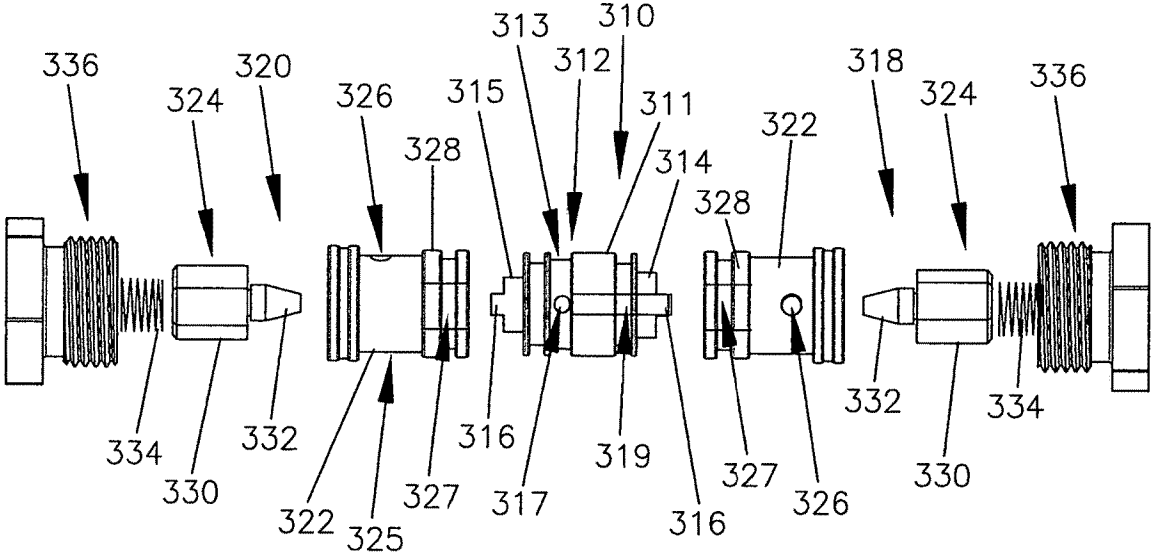
FIG. 15 is an exploded view of a valve assembly of the present invention.

As shown in FIGS. 4 and 5, the fluid circulation gear box 12 comprises a top gear box member generally indicated as 26 and a bottom gear box member generally indicated as 28 secured together by a plurality of fasteners (not shown) disposed or inserted into a corresponding plurality of holes each indicated as 30. A groove extends laterally across the upper surface 34 of the top gear box member 26 that forms a back pressure relief channel 32 with the bottom surface 435 of the manifold 14 to return excess fluid to the reservoir (not shown) at opposite ends 33 of the lateral back pressure relief channel 32 when the hydraulic external gear pump 10 is operating in the second configuration shown in FIG. 12. Opposite end portions of each lateral back pressure relief channel 32 form a notch 38 to seat the top gear box member 26 of the fluid circulation gear box 12 in a circular recess or rim 436 formed in the bottom surface 435 of the manifold 14 (FIGS. 14 and 15).

Figure 6:
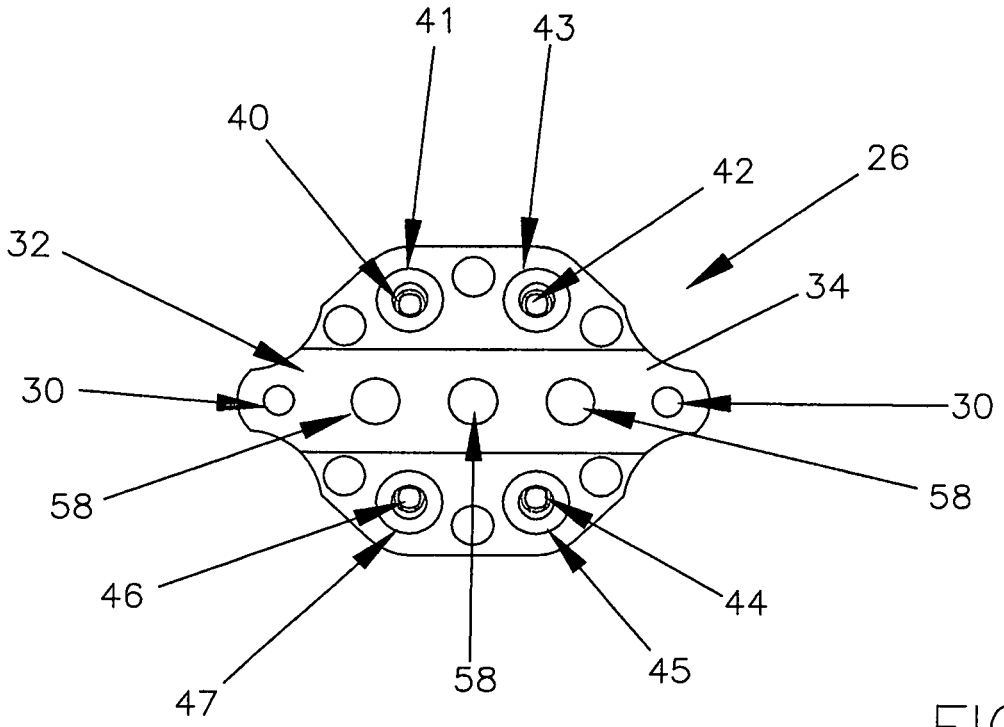
FIG. 6 is a top view of the top gear box member of the present invention.
Figure 7:
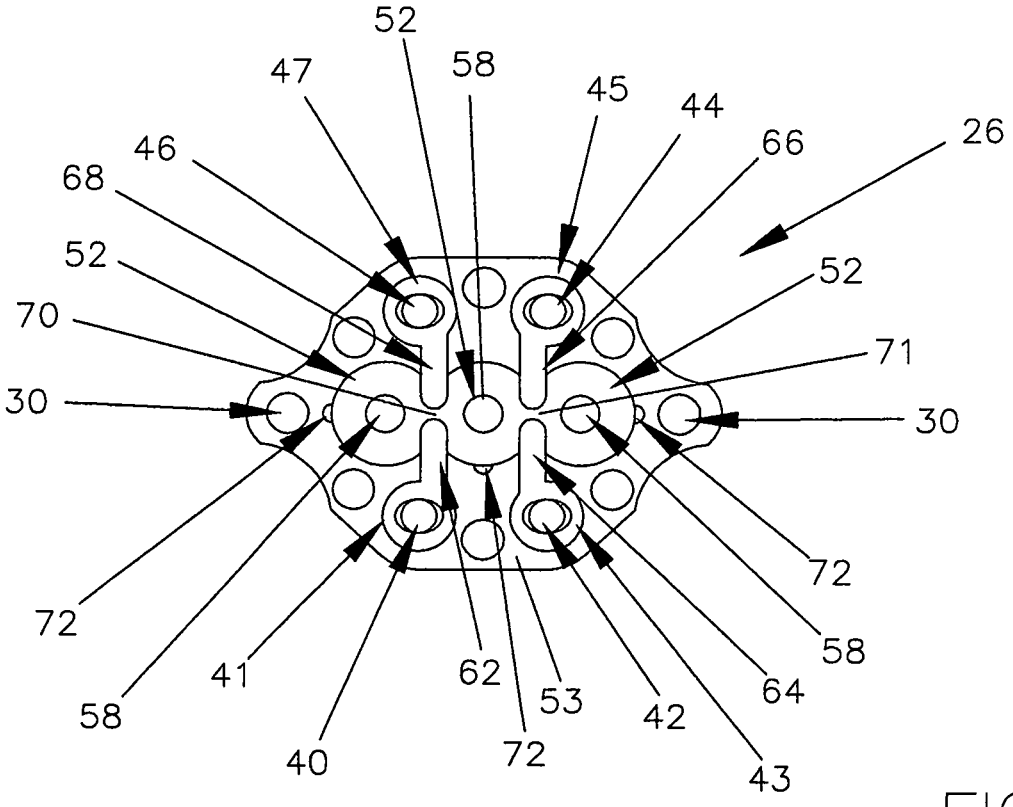
FIG. 7 is a bottom view of the top gear box member of the present invention without the fluid circulation gears.
Figure 8:
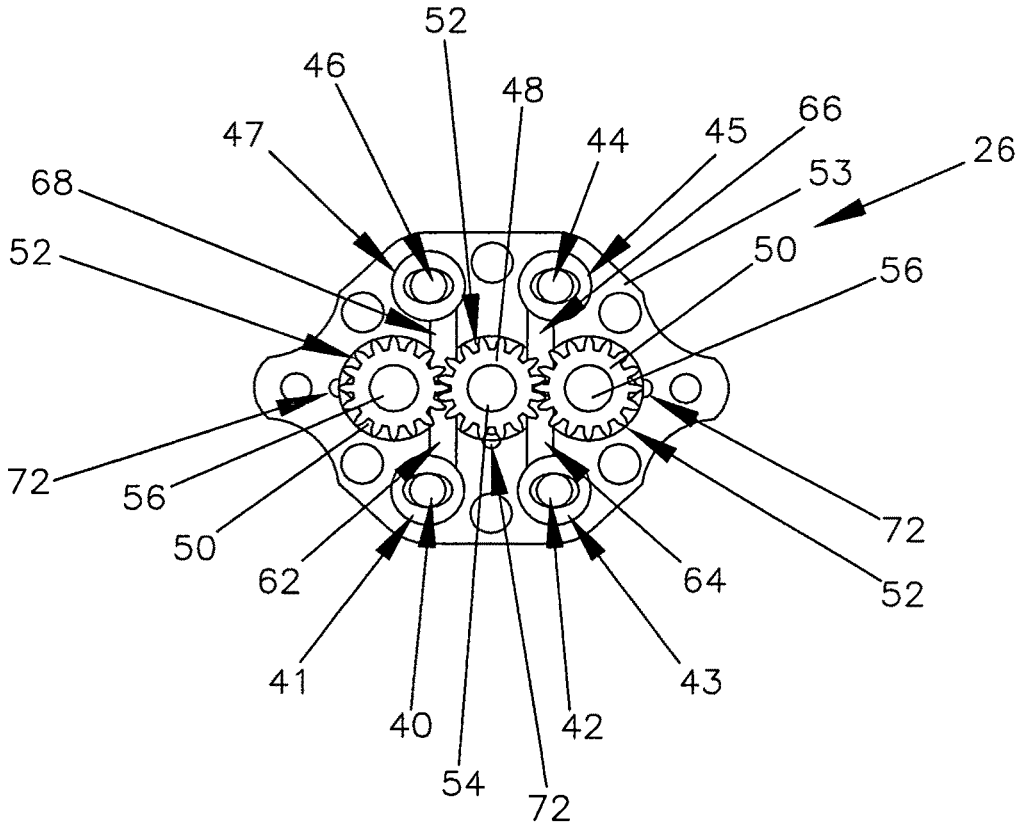
FIG. 8 is a bottom view of the top gear box member of the present invention with the fluid circulation gears assembled.

As shown in FIGS. 6 through 8, the first gear box fluid flow branch for the first hydraulic actuator (not shown) includes an upper orifice 40 and an upper recess 41 formed in the top gear box member 26 and the second fluid flow branch for the first hydraulic actuator (not shown) includes an upper orifice 46 and an upper recess 47 formed in the top gear box member 26.

As shown in FIGS. 6 through 8, the first gear box fluid flow branch for the second hydraulic actuator (not shown) includes an upper orifice 44 and an upper recess 45 formed in the top gear box member 26 and the second fluid flow branch for the second fluid flow branch for the second hydraulic actuator (not shown) includes an upper orifice 42 and an upper recess 43 formed in the top gear box member 26.

As shown in FIG. 8, the fluid circulation gear box 12 further includes a gear assembly comprising three gears that draw or pump hydraulic fluid from the reservoir (not shown) through the fluid circulation gear box 12 and the manifold 14 to the two hydraulic actuators (not shown) through four hoses or fluid conduits (not shown). A center or drive gear 48 and a pair of idler gears each indicated as 50 are disposed within a corresponding gear recess 52 formed in the lower surface 53 of the top gear box member 26 such that the teeth of the center or drive gear 48 rotating on a motor drive shaft 54 driven by a reversible electric motor (not shown) mesh with the teeth on each idler gear 50 mounted to a corresponding idler shaft 56 each disposed within a corresponding hole or recess 58 formed in the top gear box member 26 and the bottom gear box member 28.

Figure 7A:
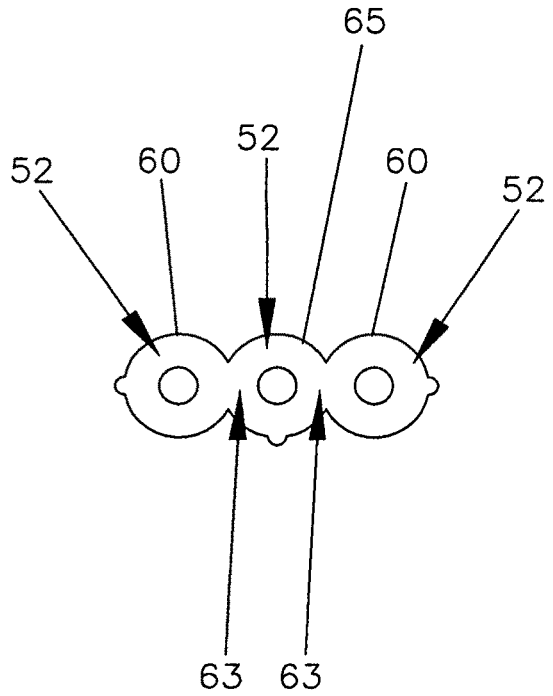
FIG. 7A is a partial bottom view of the top gear box member of the present invention depicting the gear recesses.

As shown in FIG. 8, the meshing of the gear teeth and close tolerance of the gear teeth and diameters of the corresponding gear recess 52 are such that when the fluid circulation gear box 12 is assembled the corresponding gear recesses 52 form corresponding fluid pump chambers with the upper surface 90 of the bottom gear box member 28 to pump hydraulic fluid through the fluid circulation gear box 12 between the gear teeth and side walls 60 of the gear recesses 52 (FIG. 7A). The idler gears 50 rotate in the direction opposite the rotation of the center or drive gear 48.

As shown in FIG. 7A, a space or opening 63 is formed between the side wall 60 of each idler gear recess 52 adjacent either side of the side wall 65 of the center or drive gear recess 52 providing a clearance for the gear teeth of each idler gear 50 and the center or drive gear 48 to mesh.

As shown in FIGS. 7 and 8, the first gear box fluid flow branch for the first hydraulic actuator (not shown) further includes an upper groove 62 formed in the lower surface 53 of the top gear box member 26 in fluid communication with the upper orifice 40 of the first gear box fluid flow branch through the first upper recess 41 for the first hydraulic actuator (not shown) and the second gear box fluid flow branch for the first hydraulic actuator (not shown) further includes an upper groove 68 formed in the lower surface 53 of top gear box member 26 in fluid communication with the orifice 46 of the second gear box fluid flow branch through the upper recess 47 for the first hydraulic actuator (not shown).

As shown in FIGS. 7 and 8, the first gear box fluid flow branch for the second hydraulic actuator (not shown) further includes an upper groove 66 formed in the lower surface 53 of the top gear box member 26 in fluid communication with the upper orifice 44 of the first gear box fluid flow branch through the upper recess 45 for the second hydraulic actuator (not shown) and the second gear box fluid flow branch for the second hydraulic actuator (not shown) further includes an upper groove 64 formed in the lower surface 53 of the top gear box member 26 in fluid communication with the upper orifice 42 of the second gear box fluid flow branch through the upper recess 43 for the second hydraulic actuator (not shown).

As best shown in FIG. 7, a first bridge or ridge 70 separates the upper groove 62 of the first gear box fluid flow branch for the first hydraulic actuator (not shown) from the upper groove 68 of the second gear box fluid flow branch for the first hydraulic actuator (not shown) and a second bridge or ridge 71 separates the upper groove 66 of the first gear box fluid flow branch for the second hydraulic actuator (not shown) from the upper groove 64 of the second gear box fluid flow branch for the second hydraulic actuator (not shown).

As shown in FIGS. 7 and 8, lubrication recesses each indicated as 72 are formed in the lower surface 53 of the top gear box member 26.

Figure 9:
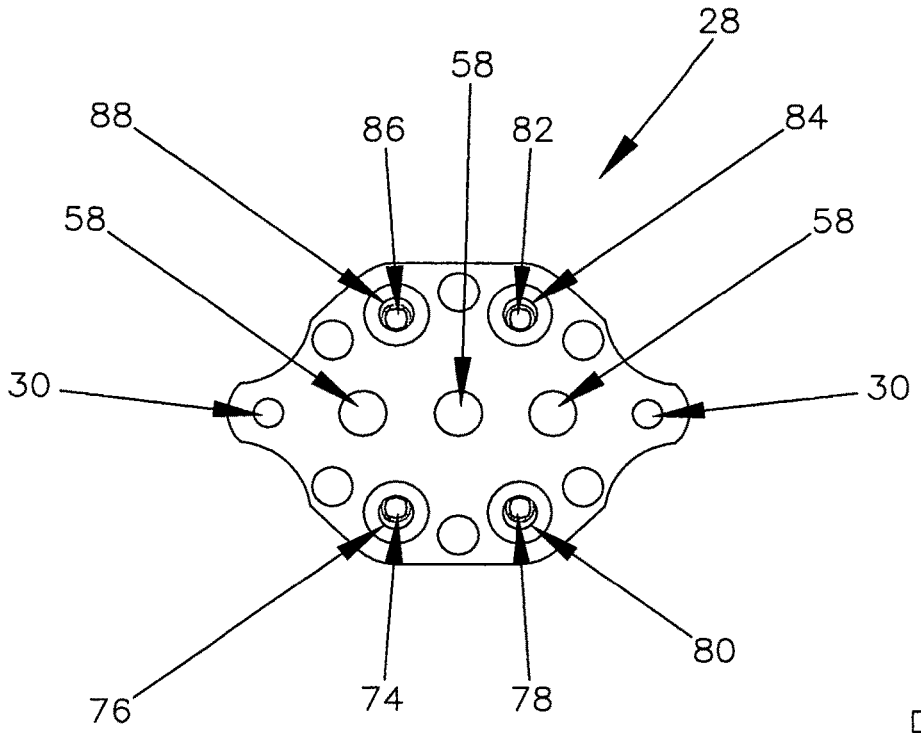
FIG. 9 is a bottom view of the bottom gear box member of the present invention.
Figure 10:
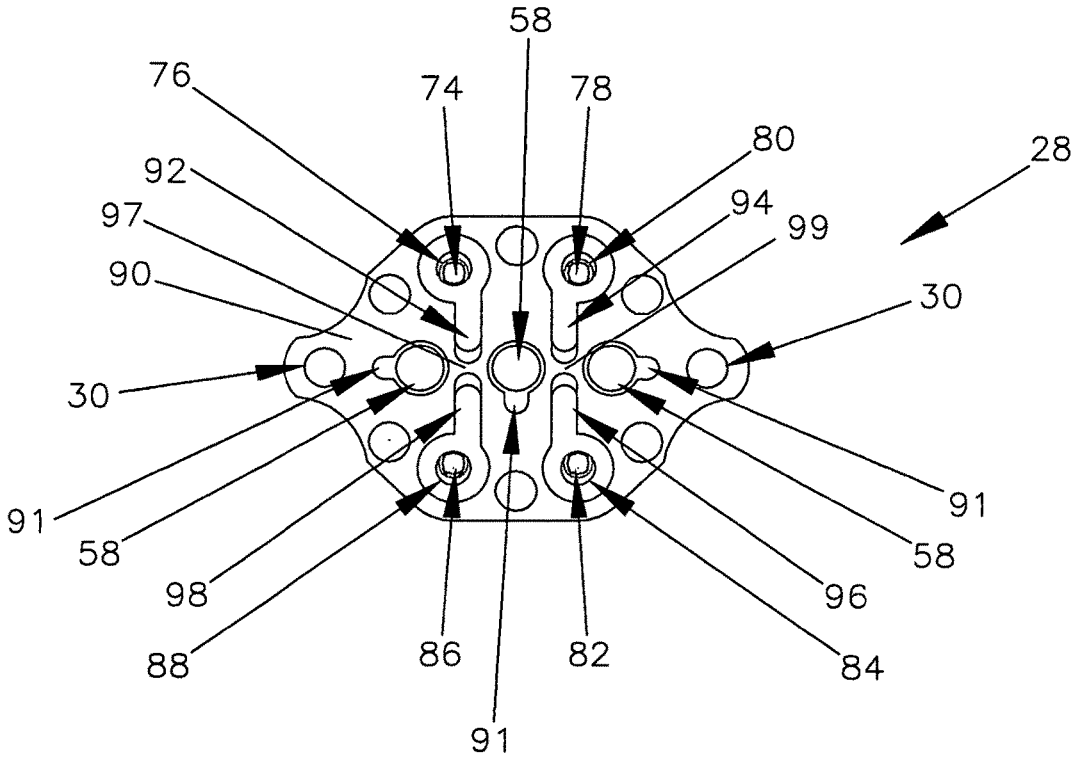
FIG. 10 is a top view of the bottom gear box member of the present invention.

FIGS. 9 and 10 depict the bottom gear box member 28. Specifically, the first gear box fluid flow branch for the first hydraulic actuator (not shown) includes a corresponding lower orifice 74 and a corresponding lower recess 76 formed in the bottom gear box member 28 and the second gear box fluid flow branch for the first hydraulic actuator (not shown) includes a lower corresponding orifice 86 and a lower recess 88 formed in the bottom gear box member 28.

The first gear box fluid flow branch for the second hydraulic actuator (not shown) includes a corresponding lower orifice 82 and a corresponding lower recess 84 formed in the bottom gear box member 28 and the second fluid flow branch for the second hydraulic actuator (not shown) includes a corresponding lower orifice 78 and a corresponding lower recess 80 formed in the bottom gear box member 28.

As shown in FIG. 10, the first gear box fluid flow branch for the first hydraulic actuator (not shown) further includes a lower groove 92 formed in the upper surface 90 of the bottom gear box member 28 in fluid communication with the lower orifice 74 of the first gear box fluid flow branch through the lower recess 76 for the first hydraulic actuator (not shown) and a lower groove 98 formed in the upper surface 90 of the bottom gear box member 28 in fluid communication with the lower orifice 86 of the second gear box fluid flow branch through the second lower recess 88 for the first hydraulic actuator (not shown).

As shown in FIG. 10, the first gear box fluid flow branch for the second hydraulic actuator (not shown) further includes a lower groove 96 formed in the upper surface 90 of the bottom gear box member 28 in fluid communication with the lower orifice 82 of the first gear box fluid flow branch of the second hydraulic actuator (not shown) through the lower recess 84 and a lower groove 94 formed in the upper surface 90 of the bottom gear box member 28 in fluid communication with the lower orifice 78 of the second gear box fluid flow path or branch of the second hydraulic actuator (not shown) through the lower recess 80 formed in the upper surface 90 of the bottom gear box member 28.

As shown in FIG. 10, a first bridge or ridge 97 separates the lower groove 92 of the first gear box fluid flow branch of the first hydraulic actuator (not shown) and the lower groove 98 of the second gear box fluid flow branch for the first hydraulic actuator (not shown) and the lower groove 96 of the first fluid flow branch for the second hydraulic actuator (not shown) and a second bridge or ridge 99 separates the lower groove 96 of the first gear box fluid flow branch for the second gear box hydraulic actuator (not shown) and the lower groove 94 of the second gear box fluid flow branch of the second hydraulic actuator (not shown).

As shown in FIG. 10, lubrication recesses each indicated as 91 are formed in the upper surface 90 of the bottom gear box member 28.

The fluid circulation gear box 12 also includes a plurality of gear box check valves to prevent fluid from flowing from the fluid circulation gear box 12 back into the reservoir (not shown) from the first hydraulic actuator (not shown) through the lower orifice 74 and lower orifice 86 of the first hydraulic actuator (not shown) formed through the bottom gear member 28 and from the first hydraulic actuator (not shown) through the lower orifice 82 and lower orifice 78 of the second hydraulic actuator (not shown) formed through the bottom gear member 28.

Figure 10A:
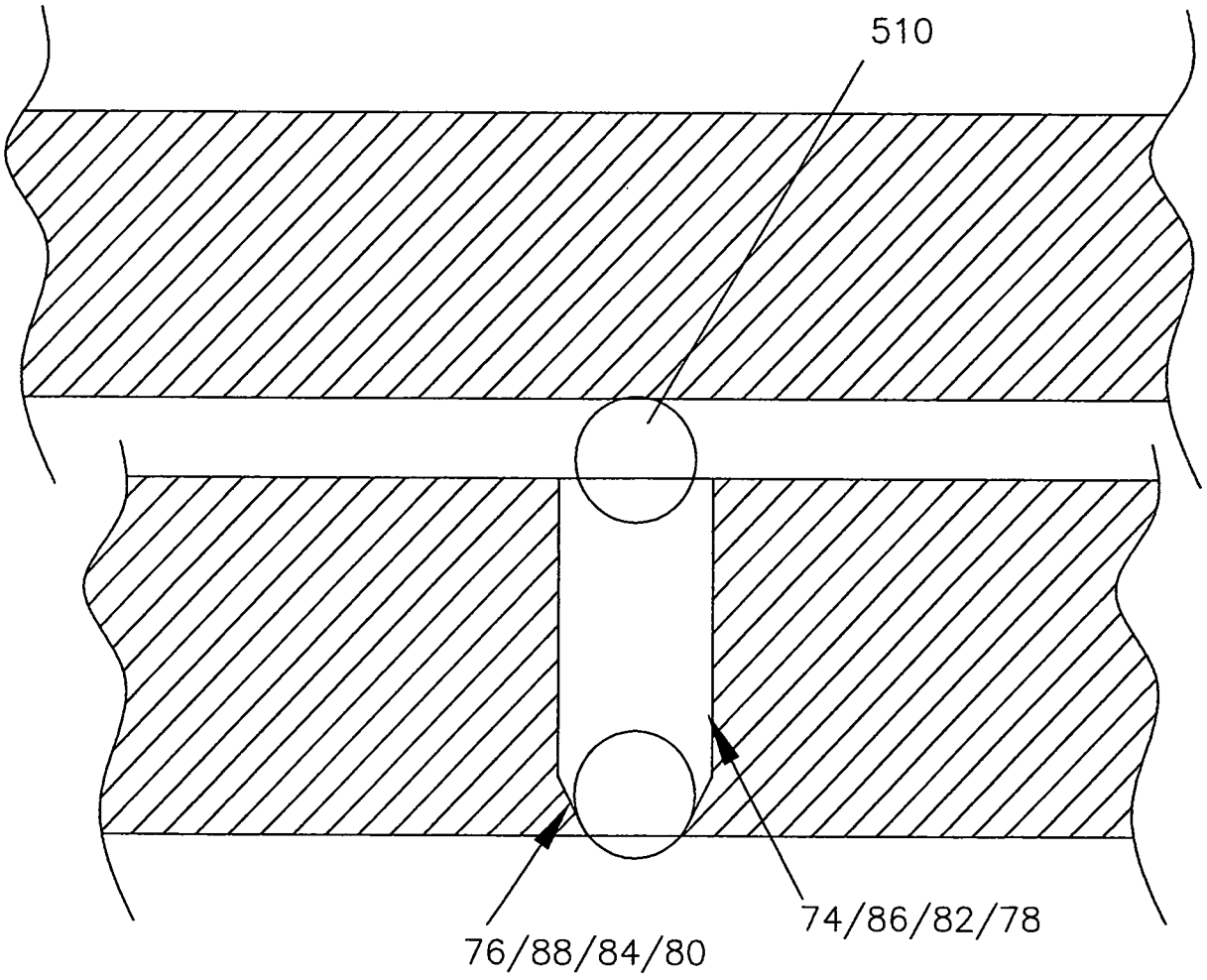
FIG. 10A is a side view of a gear box check valve of the present invention.

As shown in FIG. 10A, each gear box check valve comprises a spherical valve member or ball 510 normally seated in the lower recess 76 and the lower recess 88 to seal the lower orifice 74 and lower orifice 86 respectively and in the lower recess 84 and the lower recess 80 to seal the lower orifice 82 and the lower orifice 78 respectively. A spring or bias 512 holds or prevents each spherical valve member or ball 510 from becoming unseated unless a positive pressure is exerted when the fluid circulation gear box 12 is operating allowing fluid to flow from the reservoir (not shown) through lower orifice 74, 86, 82 and 78 to the fluid circulation gear box 12 and the manifold 14 to the hydraulic actuators (not shown) operating in either the first or down configuration or second or up configuration.

The interior of the fluid circulation gear box 12 is coupled to the reservoir (not shown) through the lower orifices 74, 78, 82 and 86 by a plurality of corresponding fluid conduits each indicated as 95.

The first gear box fluid flow branch of the first hydraulic actuator (not shown) comprises the upper orifice 40, upper recess 41 and upper groove 62 together with lower groove 98, lower recess 88 and lower orifice 86 disposed on opposite sides of the gear assembly.

The second gear box fluid flow branch of the first hydraulic actuator (not shown) comprises the upper orifice 46, upper recess 47 and upper groove 68 together with lower groove 92, lower recess 76 and lower orifice 74 disposed on opposite sides of the gear assembly.

The first gear box fluid flow branch of the second hydraulic actuator (not shown) comprises the upper orifice 44, upper recess 45 and upper groove 66 together with lower groove 94, lower recess 80 and lower orifice 78 disposed on opposite sides of the gear assembly.

The second gear box fluid flow branch of the second actuator (not shown) comprises the upper orifice 42, upper recess 43 and upper groove 64 together with lower groove 96, lower recess 84 and lower orifice 82 disposed on opposite sides of the gear assembly.

As described hereinafter, pressurized hydraulic fluid is fed alternately from the fluid circulation gear box 12 to the manifold 14 through the first gear box fluid flow branch for the first hydraulic actuator (not shown) and the first gear box fluid flow branch for the second hydraulic actuator (not shown) or the first gear box fluid flow branch for the second hydraulic actuator (not shown) and the second gear box fluid flow branch for the second hydraulic actuator (not shown).

Figure 11:
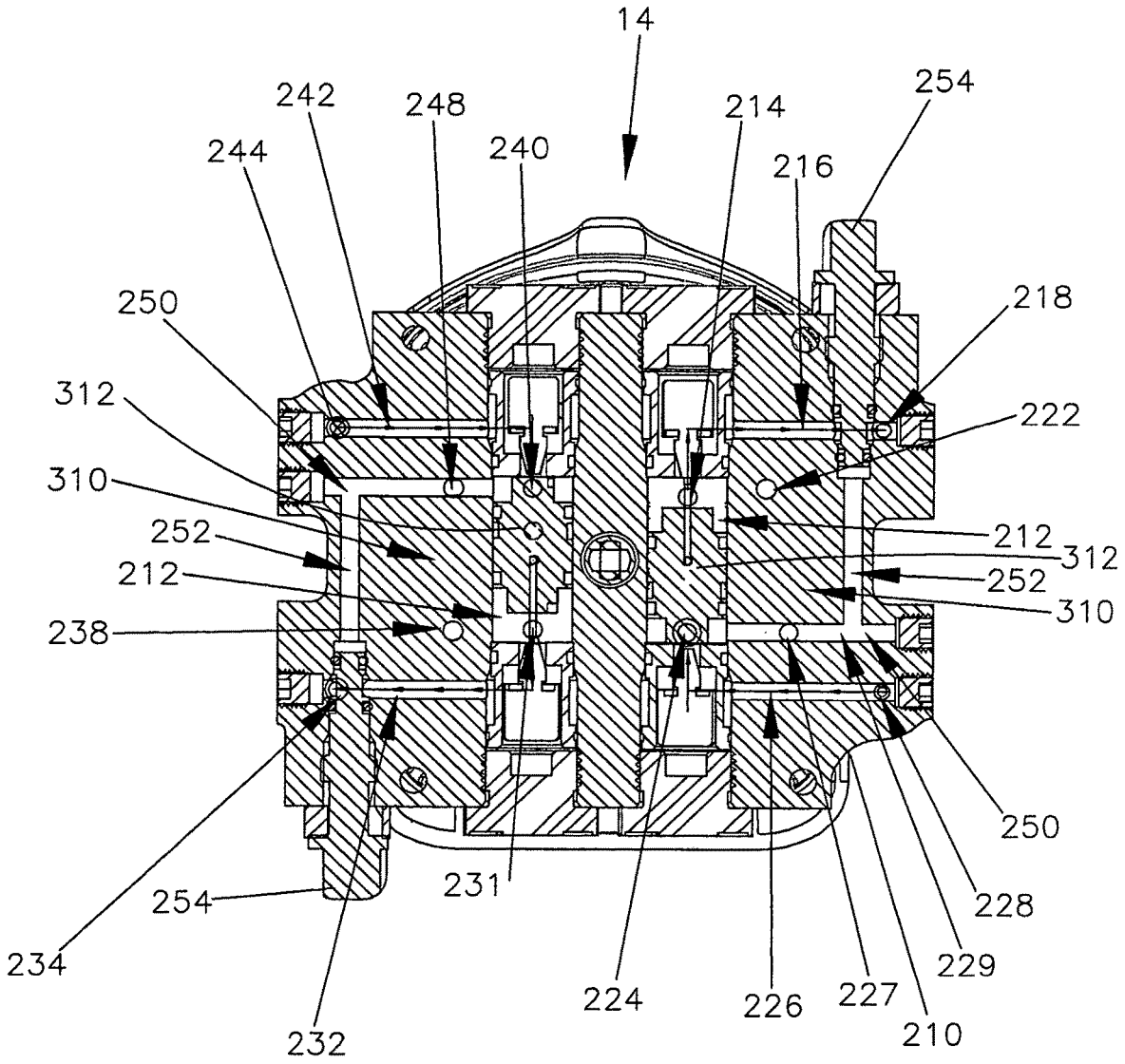
FIG. 11 is a cross-sectional bottom view of the manifold of the present invention with each valve assembly in a first fluid flow configuration.
Figure 12:
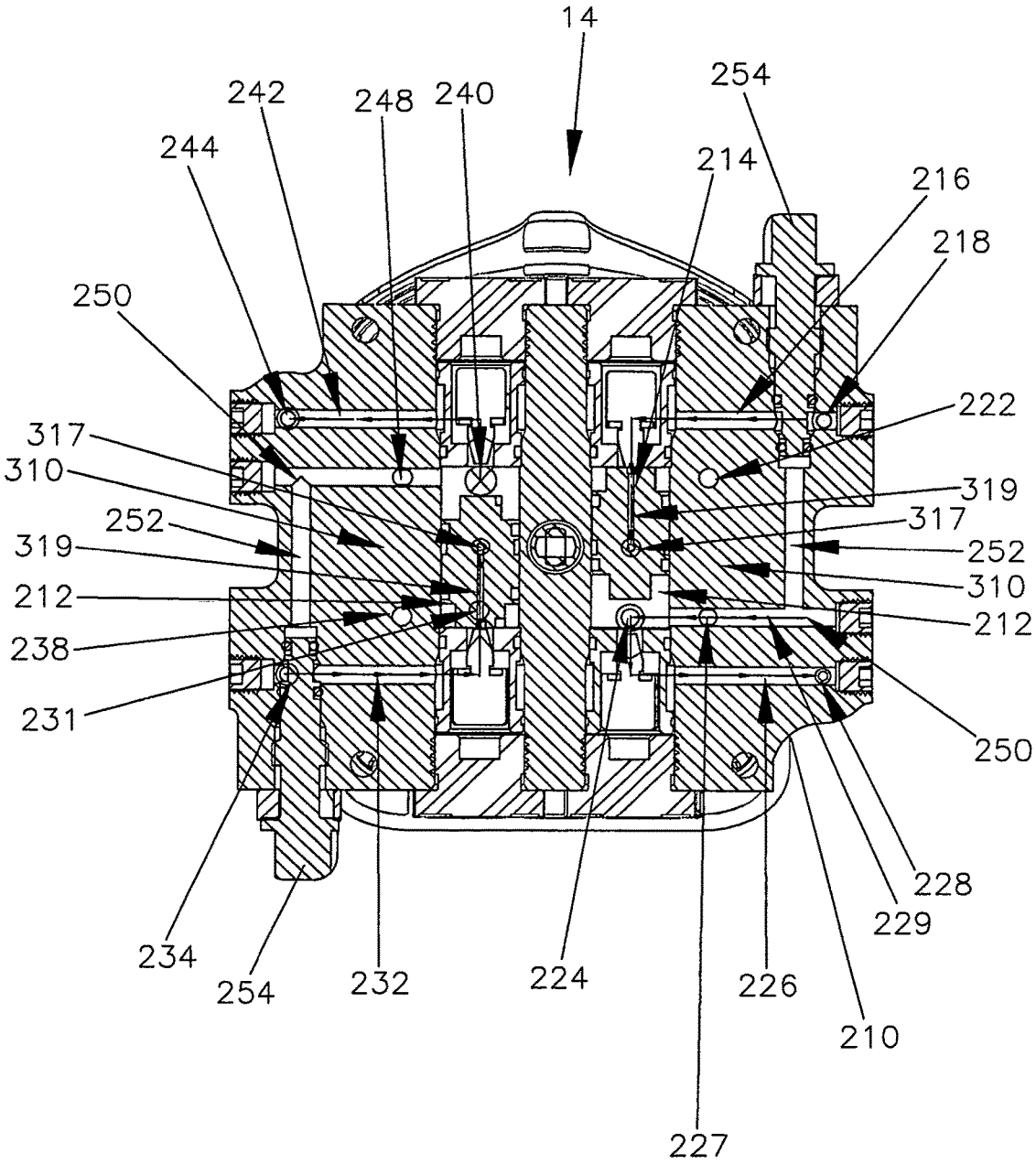
FIG. 12 is a cross-sectional bottom view of the manifold of the present invention with each valve assembly in a second fluid flow configuration.

As shown in FIGS. 11 and 12, the manifold 14 comprises a block 210 including the first manifold fluid flow branch and the second manifold fluid flow branch for the first hydraulic actuator (not shown) and the second hydraulic actuator (not shown). The direction of fluid flow through the manifold 14 for the first hydraulic actuator (not shown) and the second hydraulic actuator (not shown) is controlled by a corresponding valve assembly each generally indicated as 310 disposed within a corresponding valve chamber 212 formed in the block 210.

FIG. 11 depicts the valve assemblies 310 in a first configuration to hydraulically drive or move both hydraulic actuators (not shown) in a first direction (down) substantially simultaneous; while, FIG. 12 depicts the valve assemblies 310 in a second configuration to hydraulically drive or move both hydraulic actuators (not shown) in a second or opposite direction (up) substantially simultaneous.

The first manifold fluid flow branch for the first hydraulic actuator (not shown) includes a first orifice 214 open to the interior of the corresponding valve chamber 212 and aligned with the upper orifice 40 of the first gear box fluid flow branch and a fluid flow channel 216 aligned with a second orifice 218. The upper orifice 40 and the second orifice 218 are open to fluid flow through the corresponding shuttle actuator hole 327, interior of the hollow valve housing 322, fluid flow holes 326 and fluid channel 216 when operating in the first configuration shown in FIG. 11. The second orifice 218 is aligned with a first nipple 220 to couple the manifold 14 to a hose or fluid conduit (not shown) connected to the proximal portion of the cylinder of the first hydraulic actuator (not shown).

The first manifold fluid flow branch of the first hydraulic actuator (not shown) further includes a first pressure relief port 222 in selectively fluid communication with the valve chamber 212 of the first hydraulic actuator (not shown) through a first pressure relief channel (not shown) extending from the valve chamber 212 to the first pressure relief port 222 to bleed off excess fluid from the valve chamber 212 through a first or down pressure relief valve when the hydraulic external gear pump 10 is operating in the first or down configuration shown in FIG. 11.

The second manifold fluid flow branch for the first hydraulic actuator (not shown) includes a first orifice 224 open to the interior of the corresponding valve chamber 212 and aligned with the upper orifice 46 of the first gear box fluid flow branch and a fluid flow channel 226 aligned with a second orifice 228. The upper orifice 46 and the second orifice 228 are open to fluid flow through the corresponding shuttle actuator hole 327, interior of the hollow valve housing 322, fluid flow holes 326 and fluid channel 226 when operating in the second or down configuration shown in FIG. 12. The second orifice 228 is aligned with a second nipple 230 to couple the manifold 14 to a hose or fluid conduit (not shown) connected to the distal portion of the cylinder of the first hydraulic actuator (not shown).

The second manifold fluid flow branch of the first hydraulic actuator (not shown) also includes a second pressure relief port 227 in selective fluid communication with the valve chamber 212 of the first hydraulic actuator (not shown) through a second pressure relief channel 229 to bleed off excess fluid from the valve chamber 212 through a second or up relief valve when the hydraulic external pump 10 is operating in the second or up configuration shown in FIG. 12.

The first manifold fluid flow branch for the second hydraulic actuator (not shown) includes a first orifice 231 open to the corresponding valve chamber 212 and aligned with the upper orifice 44 of the first gear box fluid flow branch and a fluid flow channel 232 aligned with a second orifice 234. The upper orifice 44 and the second orifice 231 are open to fluid flow through the corresponding shuttle actuator hole 327, interior of the hollow valve housing 322, fluid flow holes 326 and fluid channel 232 when operating in the first or down configuration shown in FIG. 11. The second orifice 234 is aligned with a first nipple 236 to couple the manifold 14 to a hose or fluid conduit (not shown) connected to the proximal portion of the cylinder of the second hydraulic actuator (not shown).

The first branch of the second hydraulic actuator (not shown) further includes a first pressure relief port 238 in selectively fluid communication with the valve chamber 212 of the second hydraulic actuator (not shown) through a first pressure relief channel (not shown) extending between the valve chamber 212 to the first pressure relief port 238 to bleed off excess fluid when the hydraulic external gear pump 10 is operating in the first or down configuration shown in FIG. 11.

The second manifold fluid flow branch for the second hydraulic actuator (not shown) includes a first orifice 240 open to the interior of the corresponding valve chamber 212 and aligned with the upper orifice 42 of the first gear box fluid flow branch and a fluid flow channel 242 aligned with a second orifice 244. The upper orifice 42 and the second orifice 244 are open to fluid flow through the corresponding shuttle actuator hole 327, interior of the corresponding hollow valve housing 322 and fluid flow holes 326 and fluid channel 232 when operating in the second or up configuration shown in FIG. 12. The second orifice 244 is aligned with a second nipple 246 to couple the manifold 14 to a hose or fluid conduit (not shown) connected to the distal portion of the cylinder of the second hydraulic actuator (not shown).

The second manifold fluid flow branch of the second hydraulic actuator (not shown) also includes a second pressure relief port 248 in selectively fluid communication with the valve chamber 212 of the second hydraulic actuator (not shown) through a second pressure relief channel 250 to bleed off excess fluid from the valve chamber 212 through a second or up pressure relief valve when the hydraulic external gear pump 10 is operating in the second or up configuration shown in FIG. 12.

As shown in FIGS. 11 and 12, each side of the manifold 14 includes a manifold bypass that allows fluid to flow between the first manifold fluid flow branch and the second manifold fluid flow branch for each the first hydraulic actuator (not shown) and the second hydraulic actuator (not shown) bypassing the corresponding shuttle member 312 balancing the pressure in each valve chamber 212 on both sides of each corresponding shuttle member 312.

Specifically, each of the two manifold bypasses comprises a first bypass channel 250 extending laterally outward from the second manifold fluid flow branch side of the shuttle member 312 to intersect a second bypass channel 252 extending longitudinally and substantially parallel to the center line of the corresponding valve chamber 212 to intersect the corresponding fluid flow channel 216 or 232. The second bypass channel 252 of each manifold fluid bypass is normally isolated from the corresponding fluid flow channel 216 or 232 by a valve member 254 disposed within the corresponding second bypass channel 252. Moving or withdrawing the valve member 254 outwardly past the intersection of the fluid flow channel 216 or 232 and the corresponding second bypass channel 252 opens a fluid flow path between opposite sides of the shuttle member 312 through the fluid flow channel 216 or fluid flow channel 232 and corresponding second bypass channel 252 and first bypass channel 250 balancing the fluid pressure on each side of the corresponding shuttle member 312.

The hydraulic external gear pump 10 includes a separate valve assembly for the first hydraulic actuator (not shown) and the second hydraulic actuator (not shown) to control the flow of fluid between the fluid circulation gear box 12 and the first hydraulic actuator (not shown) and the second hydraulic actuator (not shown) in either the first or down configuration or second or up configuration.

Figure 16:
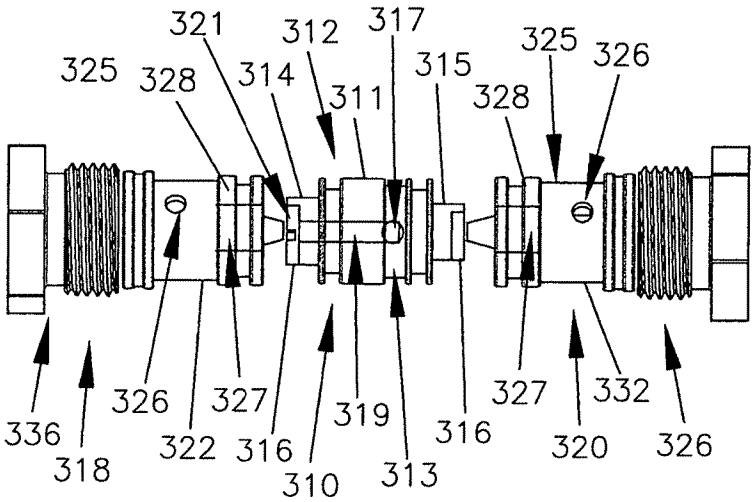
FIG. 16 is a view of an assembled valve assembly of the present invention.

As shown in FIGS. 15 and 16, each valve assembly generally indicated as 310 comprises a shuttle member generally indicated as 312 including a shuttle body 311 having a first protrusion 314 extending outwardly from a first end thereof and a second protrusion 315 extending outwardly from a second end thereof each having a spacer 316 formed on the corresponding outer end thereof. A lateral channel 317 is formed laterally through the shuttle body 311 in a shuttle groove 313 and a longitudinal channel 319 is formed between the lateral channel 317 and a slot 321 formed through the spacer 316 of the first protrusion 314.

A first check valve generally indicated as 318 and a second check valve generally indicated as 320 are disposed on opposite sides of the shuttle member 312. The shuttle member 312 separates the corresponding valve chamber 212 into the manifold fluid flow branches into the first manifold fluid flow branch and the second manifold fluid flow branch of each hydraulic actuator (not shown). The first check valve 318 and the second check valve 320 each comprises a hollow valve housing 322 to receive and house at least a portion of a corresponding valve member generally indicated as 324.

Each hollow valve housing 322 includes a valve groove 325 having at least one fluid flow hole 326 formed through the side thereof and a shuttle actuator hole 327 formed through an inner end wall 328 to receive at least a portion of the corresponding valve member 324 therein.

Each valve member 324 comprises a valve body 330 having a frustrum conical protrusion or shuttle actuator 332 extending inwardly into the corresponding shuttle actuator hole 327 of the corresponding hollow valve housing 322 to selectively seal the corresponding shuttle actuator hole 327.

Each valve member 324 is normally biased inwardly by a corresponding spring or bias 334 retained or disposed within a recess (not shown) formed in a corresponding end cap generally indicated as 336 such that the corresponding frustrum conical protrusion or shuttle actuator 332 engages the corresponding spacer 316 of the shuttle member 312 and closes or seals the corresponding shuttle actuator hole 327 shown in FIG. 16 when the dual hydraulic pump is not operating.

Seals are disposed within grooves formed on opposite ends of each hollow valve housing 322 and opposite ends of the shuttle member 312 to engage the inner surfaces of the corresponding valve chamber 214 such that corresponding shuttle grooves 313 and valve grooves 325 form fluid flow chambers with the inner surface of the corresponding valve chamber 212.

As shown in FIGS. 11, 12, 15 and 16, the first manifold fluid flow branch of the first hydraulic actuator (not shown) comprises the first orifice 214 and shuttle actuator hole 327 through the interior of the hollow valve housing 322 and fluid flow hole 326 to the fluid flow channel 216 and second orifice 218.

As shown in FIGS. 11, 12, 15 and 16, the second manifold fluid flow branch of the first hydraulic actuator (not shown) comprises the first orifice 224 and shuttle actuator hole 327 through the interior of the hollow valve housing 322 and the fluid flow hole 326 to the fluid flow channel 226 and second orifice 228.

As shown in FIGS. 11, 12, 15 and 16, the first manifold fluid flow branch of the second hydraulic actuator (not shown) comprises the first orifice 231 and shuttle actuator hole 327 through the interior of the hollow valve housing 322 and the fluid flow hole 326 to the fluid flow channel 232 and second orifice 234.

As shown in FIGS. 11, 12, 15 and 16, the second manifold fluid flow branch of the first hydraulic actuator (not shown) comprises the first orifice 240 and shuttle actuator hole 327 through the interior of the hollow valve housing 322, the fluid flow hole 326 to the fluid flow channel 242 and second orifice 244.

A first plurality of first hydraulic actuator relief valves and a second plurality of second hydraulic actuator relief valves are secured to the bottom of the manifold 14 to relieve pressure within the manifold 14 caused by excess hydraulic fluid returning the excess hydraulic fluid to the reservoir (not shown) when operating in either the first or down configuration or second or up configuration.

As shown in FIG. 14, the first plurality of relief valves comprises a first relief valve 410, a second relief valve 412 and a third relief valve 414 for the first hydraulic actuator (not shown). The second plurality of relief valves comprises a first relief valve 416, a second relief valve 418 and a third relief valve 420 for the second hydraulic actuator (not shown).

Figure 13:
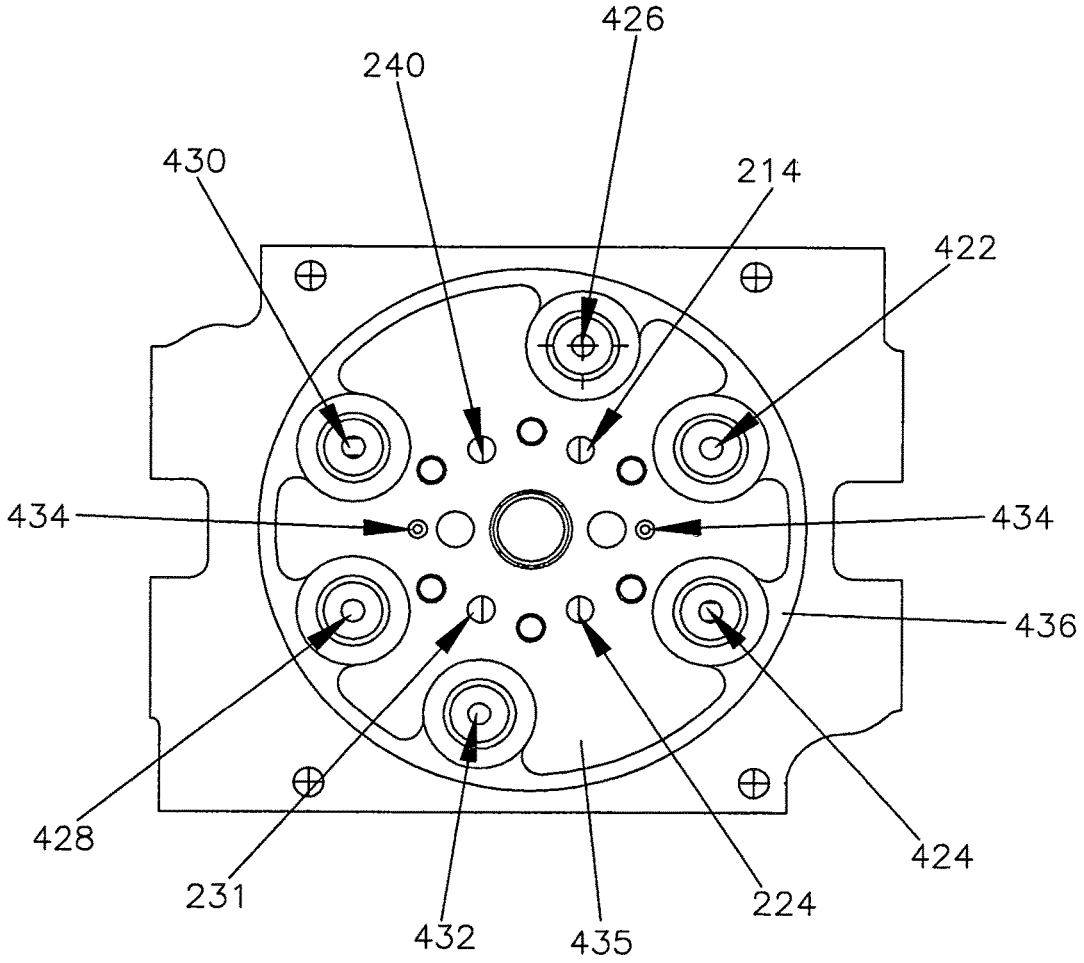
FIG. 13 is a bottom view of the manifold of the present invention.

As shown in FIG. 13, a first plurality of relief holes corresponding to the first plurality of relief valves 410/412/414 and a second plurality of relief holes corresponding to the second plurality of relief valves 416/418/420 are formed through the bottom 435 of the manifold 14. In particular, relief holes 422, 424 and 426 are aligned with relief valves 410, 412 and 414 respectively; while, relief holes 428, 430 and 432 are aligned with relief valves 416, 418 and 420 respectively.

The manifold 14 together with each valve assembly 310 also include a corresponding back pressure relief branch to return excess hydraulic fluid to the reservoir (not shown) when the hydraulic actuators (not shown) when operating in the second or up configuration.

Specifically, as shown in FIG. 12, as high-pressure fluid is pumped through the second fluid flow paths to the second side of each hydraulic actuators (not shown) low pressure fluid is returned from the opposite side of the piston of the hydraulic actuator (not shown) through the corresponding second orifice 218 or 234, fluid flow channel 216 or 232, fluid flow holes 326 to the interior of the corresponding hollow valve housing 322. Excess hydraulic fluid flows through the slot 321 and corresponding longitudinal channel 319 and lateral channel 317 through a corresponding back pressure relief hole 434 formed in the bottom 435 of the manifold 14 aligned with the lateral channel 313 and to the back pressure relief channel 32 formed in the top surface 34 of the upper gear box member 26 and into the reservoir (not shown) when the hydraulic actuators (not shown) are operating in the second or up configuration.

As previously described, the fluid circulation gear box 12 and the manifold 14 cooperatively form a first fluid flow path and a second fluid flow path to supply hydraulic fluid to and from the first hydraulic actuator (not shown) and a first fluid flow path and a second fluid flow path to supply hydraulic fluid to and from the second hydraulic actuator (not shown) to synchronize operation from the first hydraulic actuator (not shown) and the second hydraulic actuator (not shown).

The hydraulic external gear pump 10 of the present invention is specifically designed to synchronize the operation of a pair of hydraulic actuators similar in purpose to the hydraulic actuator used to raise and lower the anchor device disclosed and described in U.S. Pat. No. 6,041,730. Such a hydraulic actuator comprises a cylinder including a first or down fluid port and a second or up fluid port formed in the proximal and distal end portions thereof respectively and having a piston disposed therein coupled to a piston rod at least partially disposed within the corresponding cylinder.

When the reversible electric motor (not shown) is not operating the hydraulic pump 10 there is no fluid flow in the system.

The fluid circulation gear box 12 also includes a plurality of gear box check valves to prevent fluid from flowing back into the reservoir (not shown) from the manifold 14 and the fluid circulation gear box 12.

Figure 13A:
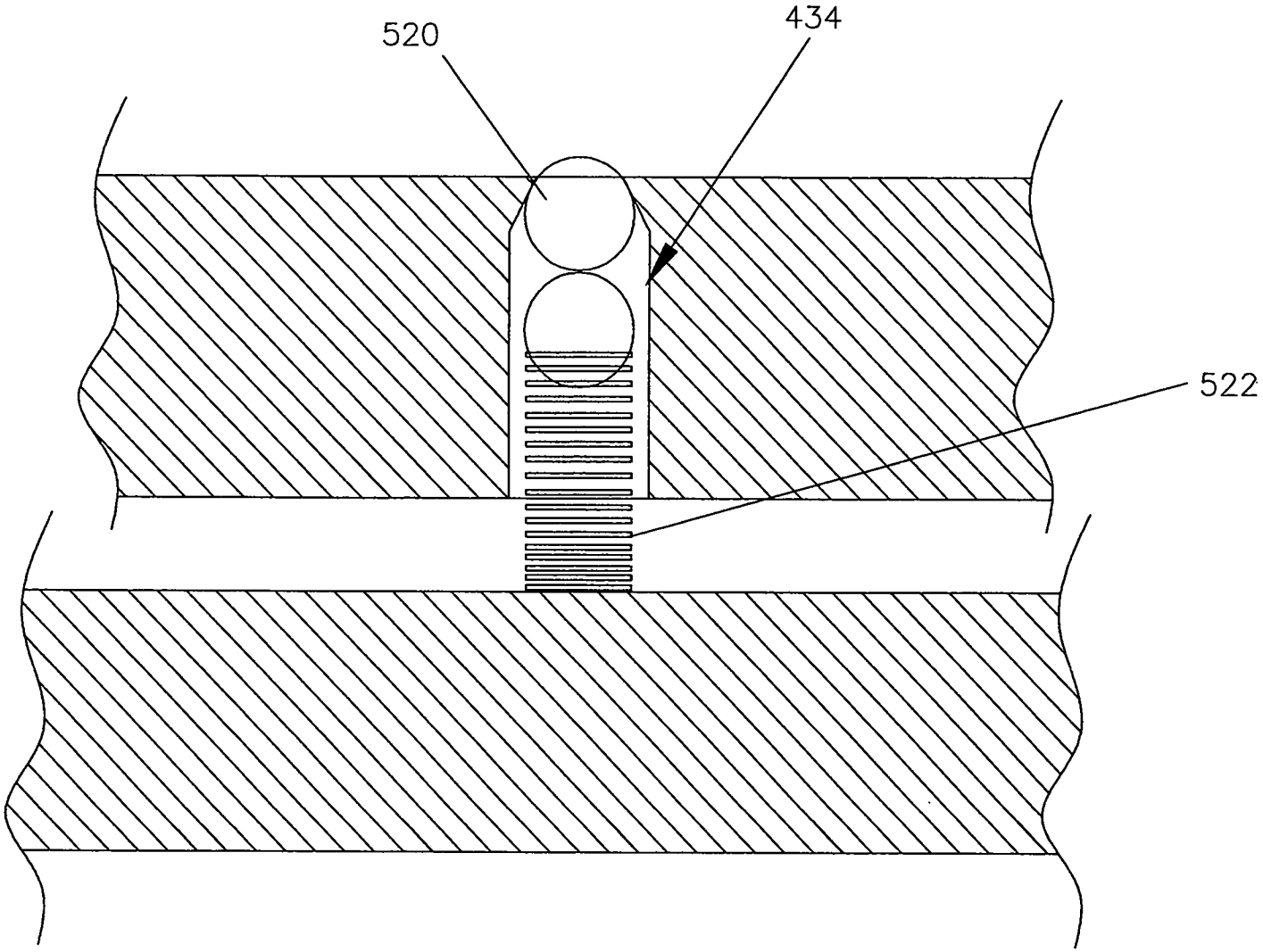
FIG. 13A is a side view of a back pressure check valve of the present invention.

Specifically, As shown in FIG. 13A, each back pressure relief branch includes a check valve to prevent air from being sucked into the system as low pressure fluid is evacuated from the proximal end of the corresponding hydraulic actuator (not shown) when operating in the first or down configuration. The check valves also allow excess fluid of recirculated fluid evacuated due to the rod displacement differences at a low pressure when operating in the second state. Each back pressure check valve comprises a spherical valve member or ball 520. A spring or bias 522 holds or prevents each spherical valve member or ball 520 from becoming unseated unless a positive pressure is exerted by the fluid recirculating from the second flow path when operating in the second or up configuration allowing fluid to flow through the back pressure relief branch to the reservoir (not shown).

When the reversible electric motor (not shown) is operating in the first direction the counter-rotating the gears 48 and 50/50 in the first direction, high pressure hydraulic fluid is fed to the first side of each piston (not shown) of the corresponding hydraulic actuator (not shown) through the first fluid flow path of each corresponding hydraulic actuator (not shown); while, low pressure hydraulic fluid is recirculated to the corresponding hydraulic actuator (not shown) to the opposite side of the corresponding piston (not shown) through the corresponding second fluid flow path driving or moving each piston of each hydraulic actuator (not shown) in the first direction deploying the anchor (not shown) into the water until both hydraulic actuators (not shown) are fully deployed.

When rotating in the opposite direction the reversible electric motor (not shown) rotates the counter-rotating gears 48 and 50/50 in the opposite direction feeding high pressure hydraulic fluid to the second or opposite side of the corresponding piston (not shown) of the corresponding hydraulic actuator (not shown) through the second corresponding fluid flow path; while, low pressure hydraulic fluid is recirculated to the opposite side of the corresponding piston (not shown), of the corresponding hydraulic actuator (not shown) through the corresponding second fluid flow path driving or moving each piston of each hydraulic actuator (not shown) in the second direction raising the anchor (not shown) from the water until both hydraulic actuators (not shown) return to a static hydraulic state and are fully retracted.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of the claims hereinafter.

What is claimed is:

1. A hydraulic gear pump to circulate hydraulic fluid to and from a reservoir and a first hydraulic actuator and a second hydraulic actuator, said hydraulic gear pump comprising a fluid circulation gear box and a manifold together with a housing to house a reversible electric drive motor together with circuitry and logic to control operation of said hydraulic gear pump and to support a control panel to control the operation of said hydraulic gear pump wherein said fluid circulation gear box includes a first gear box fluid flow branch and a second gear box fluid flow branch for the first hydraulic actuator and for the second hydraulic actuator respectively, and a first manifold fluid flow branch and a second manifold fluid flow branch for the first hydraulic actuator and for the second hydraulic actuator respectively wherein said first gear box fluid flow branch of the first hydraulic actuator and said first manifold fluid flow branch of the first hydraulic actuator form a first actuator fluid flow path between the reservoir and the first hydraulic actuator, and said second gear box fluid flow branch of the first hydraulic actuator and said second manifold fluid flow branch of the first hydraulic actuator form a second actuator fluid flow path between the reservoir and the first hydraulic actuator and wherein said first gear box fluid flow branch of the second hydraulic actuator and said first manifold fluid flow branch of the second hydraulic actuator form a first fluid flow path between the reservoir and the second hydraulic actuator and said second gear box fluid flow branch of the second hydraulic actuator and said second manifold fluid flow branch of the second hydraulic actuator form a second fluid flow path between the reservoir and the second hydraulic actuator.

2. The hydraulic gear pump of claim 1 wherein said fluid circulation gear box comprises a top gear box member and a bottom gear box member, a groove extending laterally across an upper surface of said top gear box member that forms a back pressure relief channel with a bottom surface of said manifold to return excess fluid to the reservoir at opposite ends of said lateral back pressure relief channel.

3. The hydraulic gear pump of claim 2 further including lubrication recesses formed in said lower surface of said top gear box member.

4. The hydraulic gear pump of claim 2 wherein said first gear box fluid flow branch for the first hydraulic actuator includes an upper orifice and an upper recess formed in said top gear box member and said second fluid flow branch for the first hydraulic actuator includes an upper orifice and an upper recess formed in said top gear box member and said first gear box fluid flow branch for the second hydraulic actuator includes an upper orifice and an upper recess formed in said top gear box member and said second fluid flow branch for the second hydraulic actuator includes an upper orifice and an upper recess formed in said top gear box member.

5. The hydraulic gear pump of claim 4 wherein said fluid circulation clear box further includes a gear assembly comprising three gears that draw or pump hydraulic fluid from the reservoir through said fluid circulation gear box and said manifold to the two hydraulic actuators through four hoses or fluid conduits comprising a center or drive gear and a pair of idler gears disposed within a corresponding gear recess formed in a lower surface of said top gear box member such that teeth of said center or drive gear rotating on a motor drive shaft driven by the reversible electric motor mesh with teeth on each said idler gear mounted to a corresponding idler shaft disposed within a corresponding hole or recess formed in said top gear box member and said bottom gear box member.

6. The hydraulic gear pump of claim 5 wherein meshing of said gear teeth within corresponding gear recesses form corresponding fluid pump chambers with an upper surface of said bottom gear box member to pump hydraulic fluid through said fluid circulation gear box between said gear teeth and side walls of said gear recesses.

7. The hydraulic gear pump of claim 6 wherein an opening is formed between said side wall of each said idler gear recess adjacent either side of said side wall of said center or drive gear recess providing a clearance for said gear teeth of each said idler gear and said center or drive gear to mesh.

8. The hydraulic gear pump of claim 4 wherein said first gear box fluid flow branch for the first hydraulic actuator further includes an upper groove formed in a lower surface of said top gear box member in fluid communication with said upper orifice of said first gear box fluid flow branch through said first upper recess for the first hydraulic actuator and said second gear box fluid flow branch for the first hydraulic actuator further includes an upper groove formed in the lower surface of said top gear box member in fluid communication with said orifice of said second gear box fluid flow branch through said upper recess for the first hydraulic actuator and wherein said first gear box fluid flow branch for the second hydraulic actuator further includes an upper groove formed in said lower surface of said top gear box member in fluid communication with said upper orifice of said first gear box fluid flow branch through the upper recess for said second hydraulic actuator and said second gear box fluid flow branch for the second hydraulic actuator further includes an upper groove formed in said lower surface of said top gear box member in fluid communication with said upper orifice of said second gear box fluid flow branch through said upper recess for the second hydraulic actuator.

9. The hydraulic gear pump of claim 8 further including a first bridge or ridge separating said upper groove of said first gear box fluid flow branch for the first hydraulic actuator from said upper groove of said second gear box fluid flow branch for the first hydraulic actuator and a second bridge or ridge separating said upper groove of said first gear box fluid flow branch for the second hydraulic actuator from said upper groove of said second gear box fluid flow branch for the second hydraulic actuator.

10. The hydraulic gear pump of claim 9 wherein said first gear box fluid flow branch for the first hydraulic actuator includes a corresponding lower orifice and a corresponding lower recess formed in said bottom gear box member and said second gear box fluid flow branch for the first hydraulic actuator includes a corresponding lower orifice and a corresponding lower recess formed in said bottom gear box member and said first gear box fluid flow branch for the second hydraulic actuator includes a corresponding lower orifice and a corresponding lower recess formed in said bottom gear box member and said second fluid flow branch for the second hydraulic actuator includes a corresponding lower orifice and a corresponding lower recess formed in said bottom gear box member.

11. The hydraulic gear pump of claim 10 wherein said first gear box fluid flow branch for the first hydraulic actuator further includes a lower groove formed in an upper surface of said bottom gear box member in fluid communication with said corresponding lower orifice of said first gear box fluid flow branch through said corresponding lower recess for the first hydraulic actuator and a lower groove formed in said upper surface of said bottom gear box member in fluid communication with said corresponding lower orifice of said second gear box fluid flow branch through said corresponding lower recess for the first hydraulic actuator and wherein said first gear box fluid flow branch for the second hydraulic actuator further includes a lower groove formed in said upper surface of said bottom gear box member in fluid communication with said corresponding lower orifice of said first gear box fluid flow branch of the second hydraulic actuator through said corresponding lower recess and a lower groove formed in said upper surface of said bottom gear box member in fluid communication with said corresponding lower orifice of said second gear box fluid flow path of the second hydraulic actuator through said corresponding lower recess formed in said upper surface of said bottom gear box member.

12. The hydraulic gear pump of claim 11 wherein a first bridge or ridge separating said lower groove of said first gear box fluid flow branch of the first hydraulic actuator and said lower groove of said second gear box fluid flow branch for the first hydraulic actuator and said lower groove of said first fluid flow branch for the second hydraulic actuator and a second bridge or ridge separating said lower groove of said first gear box fluid flow branch for said second gear box hydraulic actuator and said lower groove of said second gear box fluid flow branch of the second hydraulic actuator.

13. The hydraulic gear pump of claim 12 further including lubrication recesses formed in said upper surface of said bottom gear box member.

14. The hydraulic gear pump of claim 11 wherein said fluid circulation gear box further includes a plurality of gear box check valves to prevent fluid backflow from flowing from said fluid circulation gear box into the reservoir from the first hydraulic actuator through said corresponding lower orifices formed through said bottom gear box member and from the second hydraulic actuator through said corresponding lower orifices formed through said bottom gear box.

15. The hydraulic gear pump of claim 14 wherein each said gear box check valve comprises a spherical valve member or ball normally seated in each said lower recess to seal each said lower orifice and said lower orifice respectively in fluid communication with the first hydraulic actuator and a spherical valve member or ball normally seated in each said lower recess and said lower recess to seal each said lower orifice in fluid communication with the second hydraulic actuator.

16. The hydraulic gear pump of claim 15 wherein a bias to hold or prevent each said spherical valve member or ball from becoming unseated unless a positive pressure is exerted when said fluid circulation gear box is operating allowing fluid to flow from the reservoir through said lower orifices to said fluid circulation gear box and said manifold to the hydraulic actuators operating in either a first configuration or a second configuration.

17. The hydraulic gear pump of claim 11 wherein an interior of said fluid circulation gear box is coupled to the reservoir through said lower orifices by a plurality of corresponding fluid conduits.

18. The hydraulic gear pump of claim 11 wherein said first gear box fluid flow branch of the first hydraulic actuator comprises said upper orifice, said upper recess and said upper groove together with said lower groove, said lower recess and said lower orifice disposed on opposite sides of said gear box and said second gear box fluid flow branch of the first hydraulic actuator comprises said upper orifice, said upper recess and said upper groove together with said lower groove, said lower recess and said lower orifice disposed on opposite sides of said gear assembly and said first gear box fluid flow branch of the second hydraulic actuator comprises said upper orifice, said upper recess and said upper groove together with said lower groove, said lower recess and lower orifice disposed on opposite sides of said gear assembly.

19. A hydraulic gear pump to circulate hydraulic fluid to and from a reservoir and a first hydraulic actuator and a second hydraulic actuator, said hydraulic gear pump comprising a fluid circulation gear box and a manifold together with a housing to house a reversible electric drive motor together with circuitry and logic to control operation of said hydraulic gear pump and to support a control panel to control the operation of said hydraulic gear pump wherein said manifold comprises a block including a first manifold fluid flow branch, a second manifold fluid flow branch and a valve assembly disposed with a valve chamber for the first hydraulic actuator, and a first manifold fluid flow branch, a second fluid flow branch and a valve assembly disposed within a valve chamber for the second hydraulic actuator such that the direction of fluid flow through said manifold for the first hydraulic actuator and the second hydraulic actuator is controlled by a said corresponding valve assembly, each said valve assembly operable in a first configuration to hydraulically drive or move each hydraulic actuator in a first direction simultaneous; or in a second configuration to hydraulically drive or move each hydraulic actuator in a second direction simultaneous.

20. The hydraulic gear pump of claim 19 wherein said first manifold fluid flow branch for the first hydraulic actuator includes a first orifice open to an interior formed in said corresponding valve chamber and aligned with an upper orifice of first gear box fluid flow branch and a fluid flow channel aligned with a second orifice, said upper orifice and said second orifice are open to fluid flow through a corresponding shuttle actuator hole, interior of said corresponding valve chamber, fluid flow holes and fluid channel when operating in the first configuration; said second orifice is aligned with a first nipple to couple said manifold to a the proximal portion of the first hydraulic actuator; and said second manifold fluid flow branch for the first hydraulic actuator includes a first orifice open to an interior of a formed in said corresponding valve chamber and aligned with an upper orifice of said first gear box fluid flow branch and a fluid flow channel aligned with a second orifice; said upper orifice and said second orifice are open to fluid flow through a corresponding shuttle actuator hole, interior of said corresponding valve chamber, fluid flow holes and fluid channel when operating in the second configuration; said second orifice is aligned with a second nipple to couple said manifold to the distal portion of the first hydraulic actuator, said first manifold fluid flow branch for the second hydraulic actuator includes a first orifice open to an interior of said corresponding valve chamber and aligned with an upper orifice of said first gear box fluid flow branch and a fluid flow channel aligned with a second orifice; said upper orifice and said second orifice are open to fluid flow through a corresponding shuttle actuator hole, interior of said corresponding valve chamber, fluid flow holes and fluid channel when operating in the first configuration; said second orifice is aligned with a first nipple to couple said manifold to the proximal portion of of said second hydraulic actuator; and said second manifold fluid flow branch for the second hydraulic actuator includes a first orifice open to an interior of said corresponding valve chamber and aligned with an upper orifice of said first gear box fluid flow branch and a fluid flow channel aligned with a second orifice; said upper orifice and said second orifice are open to fluid flow through a corresponding shuttle actuator hole, interior of said corresponding valve chamber, fluid flow holes and a fluid channel when operating in the second configuration, said second orifice is aligned with a second nipple to couple said manifold to a distal portion of said cylinder of the second hydraulic actuator.

21. The hydraulic gear pump of claim 19 wherein said first manifold fluid flow branch of the first hydraulic actuator further includes a first pressure relief port in fluid communication with said valve chamber of the first hydraulic actuator through a first pressure relief channel extending from said valve chamber through a first pressure relief valve when said hydraulic gear pump is operating in the first configuration; said second manifold fluid flow branch of the first hydraulic actuator further includes a second pressure relief port in selective fluid communication with said valve chamber of the first hydraulic actuator through a second pressure relief channel to bleed off excess fluid from said valve chamber through a second relief valve when said hydraulic pump is operating in the second configuration; said first manifold fluid flow branch of the second hydraulic actuator further includes a first pressure relief port in fluid communication with said valve chamber of the second hydraulic actuator through a first pressure relief channel extending between said valve chamber to said first pressure relief port to bleed off excess fluid when said hydraulic gear pump is operating in the first configuration and said second manifold fluid flow branch of the second hydraulic actuator further includes a second pressure relief port in fluid communication with said valve chamber of the second hydraulic actuator through a second pressure relief channel to bleed off excess fluid from said valve chamber through a second pressure relief valve when said hydraulic gear pump is operating in the second configuration.

22. The hydraulic gear pump of claim 19 wherein each side of said manifold includes a manifold bypass that allows fluid to flow between said first manifold fluid flow branch and said second manifold fluid flow branch for each the first hydraulic actuator and the second hydraulic actuator bypassing a shuttle member disposed in each said valve chamber balancing the pressure in each said valve chamber on both sides of each said corresponding shuttle member.

23. The hydraulic gear pump of claim 22 wherein said manifold comprises a first bypass channel extending laterally outward from said second manifold fluid flow branch of said corresponding shuttle member to intersect a second bypass channel extending longitudinally and substantially parallel to a center line of said corresponding valve chamber to intersect said a corresponding fluid flow channel formed in said block and said second bypass channel of each said manifold fluid bypass is normally isolated from said corresponding fluid flow channel by a valve member disposed within said corresponding second bypass channel such that withdrawing said valve member outwardly past said intersection of said fluid flow channel and said corresponding second bypass channel opens a fluid flow path between opposite sides of said corresponding shuttle member through said corresponding fluid flow channel and corresponding second bypass channel and said first bypass channel balancing the fluid pressure on each side of said corresponding shuttle member.

24. The hydraulic gear pump of claim 19 wherein each valve assembly comprises a shuttle member including a shuttle body having a first protrusion extending outwardly from a first end thereof and a second protrusion extending outwardly from a second end thereof each having a spacer formed on a corresponding outer end thereof and later lateral channel is formed laterally through said shuttle body in a shuttle groove and a longitudinal channel is formed between said later lateral channel and a slot formed through said spacer of said first protrusion.

25. The hydraulic gear pump of claim 24 wherein a first check valve and a second check valve are disposed on opposite sides of said shuttle member and said shuttle member separates a corresponding valve chamber into said manifold fluid flow branches into said first manifold fluid flow branch and said second manifold fluid flow branch of each hydraulic actuator, said first check valve and said second check valve each comprises a hollow valve housing to receive and house at least a portion of a corresponding valve member.

26. The hydraulic gear pump of claim 25 wherein each said hollow valve housing includes a valve groove having at least one fluid flow hole formed through the side thereof and a shuttle actuator hole formed through an inner end wall to receive at least a portion of a corresponding valve member therein.

27. The hydraulic gear pump of claim 26 wherein each said valve member comprises a valve body having a frustrum conical protrusion or shuttle actuator extending inwardly into a corresponding shuttle actuator hole of a corresponding hollow valve housing to selectively seal said corresponding shuttle actuator hole.

28. The hydraulic gear pump of claim 27 each said valve member is normally biased inwardly by a corresponding bias retained or disposed within a recess formed in a corresponding end cap such that said corresponding frustrum conical protrusion or shuttle actuator engages said corresponding spacer of said shuttle member to seal said corresponding shuttle actuator hole when said hydraulic clear pump is not operating.

29. The hydraulic gear pump of claim 28 wherein said first manifold fluid flow branch of the first hydraulic actuator comprises first orifice and said shuttle actuator hole through said interior of said valve chamber and said fluid flow hole to said fluid flow channel and a second orifice, said first manifold fluid flow branch of the second hydraulic actuator comprises first orifice and said shuttle actuator through said interior of said valve chamber and said fluid flow hole to said fluid flow channel and a second orifice, and said second manifold fluid flow branch of the first hydraulic actuator comprises a first orifice and said shuttle actuator hole through the interior of said valve chamber, said fluid flow hole to said fluid flow channel and a second orifice.

30. The hydraulic gear pump of claim 29 wherein a first plurality of relief valves comprises a first relief valve, a second relief valve and a third relief valve for the first hydraulic actuator and a second plurality of relief valves comprises a first relief valve, a second relief valve and a third relief valve for the second hydraulic actuator.

31. The hydraulic gear pump of claim 30 wherein a first plurality of relief holes is aligned with said corresponding first plurality of relief valves and a second plurality of relief holes is aligned with said second plurality of relief valves are formed through said bottom of said manifold.

32. The hydraulic gear pump of claim 31 wherein each said valve assembly includes a corresponding back pressure relief branch to return excess hydraulic fluid to the reservoir when the hydraulic actuators are operating so that second configuration such that as high pressure fluid is pumped through said second fluid flow paths to the second side of each hydraulic actuators low pressure fluid is returned from the opposite side of the piston of the hydraulic actuator through said corresponding second orifice, fluid flow channel, fluid flow holes to said interior of said corresponding valve chamber and excess hydraulic fluid flows through the slot and corresponding longitudinal channel and a lateral channel through a corresponding back pressure relief hole formed in said bottom of said manifold aligned with said lateral channel and to said a back pressure relief channel formed in a top surface of said upper gear box member and into the reservoir.

* * * * *